US008727331B2

(12) United States Patent
Miyake et al.

(10) Patent No.: US 8,727,331 B2
(45) Date of Patent: May 20, 2014

(54) SHEET BUFFER APPARATUS, POST-PROCESSING APPARATUS, CONTROL METHOD, AND IMAGE FORMING APPARATUS

(71) Applicant: Canon Kabushiki Kaisha, Tokyo (JP)

(72) Inventors: Toshiyuki Miyake, Abiko (JP); Mitsuhiko Sato, Kashiwa (JP); Takashi Yokoya, Kashiwa (JP); Yutaka Ando, Toride (JP); Hidenori Matsumoto, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 14/032,627

(22) Filed: Sep. 20, 2013

(65) Prior Publication Data

US 2014/0021675 A1 Jan. 23, 2014

Related U.S. Application Data

(62) Division of application No. 13/109,351, filed on May 17, 2011, now Pat. No. 8,573,582.

(30) Foreign Application Priority Data

May 18, 2010 (JP) ..... 2010-114709
Apr. 4, 2011 (JP) ..... 2011-083126

(51) Int. Cl.
*B65H 39/00* (2006.01)

(52) U.S. Cl.
USPC ..... 270/58.1; 270/58.01; 270/60

(58) Field of Classification Search
USPC ..... 270/58.01, 58.1, 58.07, 58.08, 60
See application file for complete search history.

(56) References Cited

U.S. PATENT DOCUMENTS

| | | | |
|---|---|---|---|
| 6,672,586 | B2 | 1/2004 | Murata et al. |
| 7,354,034 | B2 | 4/2008 | Nakamura et al. |
| 7,497,425 | B2 | 3/2009 | Taguchi et al. |
| 7,780,159 | B2 | 8/2010 | Nishimura et al. |
| 2002/0014733 | A1 | 2/2002 | Miyake et al. |
| 2003/0006548 | A1 | 1/2003 | Murata et al. |
| 2005/0206064 | A1 | 9/2005 | Moriyama et al. |
| 2006/0290044 | A1 | 12/2006 | Taguchi et al. |
| 2011/0285071 | A1 | 11/2011 | Miyake et al. |

FOREIGN PATENT DOCUMENTS

| | | | |
|---|---|---|---|
| JP | 9-048545 | A | 2/1997 |
| JP | 10194582 | A | 7/1998 |
| JP | 10-279166 | A | 10/1998 |
| JP | 2001097631 | A | 4/2001 |

OTHER PUBLICATIONS

Extended European Search Report for EP 11163348.3, dated Nov. 22, 2011. Cited in parent U.S. Appl. No. 13/109,351.

*Primary Examiner* — Leslie A Nicholson, III
(74) *Attorney, Agent, or Firm* — Rossi, Kimms & McDowell LLP

(57) ABSTRACT

A sheet buffer apparatus retains a sheet to be conveyed to a post-processing unit and is configured to perform post-processing for a sheet. The apparatus comprises a buffer unit configured to perform buffer processing to retain a sheet to be conveyed to the post-processing unit and overlay the sheet to be retained and a succeeding sheet, a determination unit configured to determine whether a sheet is inhibited from the buffer processing by the buffer unit, and a control unit configured, when the determination unit determines that the sheet succeeding the sheet to be retained is a sheet for which the buffer processing is inhibited, to control the buffer unit not to perform the retaining of the sheet to be retained.

11 Claims, 20 Drawing Sheets

FIG. 13A

| |
|---|
| SHEET ID |
| PAPER WIDTH [mm] |
| PAPER LENGTH [mm] |
| GRAMMAGE [gsm] |
| SHEET MATERIAL TYPE |
| POST-PROCESSING MODE |
| STANDARD SHEET INTERVAL TIME [msec] |
| ⋮ |
| PAPER WIDTH OF NEXT SHEET [mm] |
| PAPER LENGTH OF NEXT SHEET [mm] |
| GRAMMAGE OF NEXT SHEET [gsm] |
| SHEET MATERIAL TYPE OF NEXT SHEET |

FORMAT OF SHEET INFORMATION NOTIFICATION

FIG. 13B

| |
|---|
| SHEET ID |
| NECESSARY SHEET INTERVAL TIME [msec] |

FORMAT OF SHEET INTERVAL INFORMATION NOTIFICATION

FIG. 15

| | | | SHEET N | | | | |
|---|---|---|---|---|---|---|---|
| | | DISCHARGE DESTINATION | TRAY 701 | TRAY 700 | | | |
| | DISCHARGE DESTINATION | POST-PROCESSING MODE | SORT | SORT | SINGLE STITCHING (NEAR SIDE) | SINGLE STITCHING (FAR SIDE) | DOUBLE STITCHING |
| SHEET N−1 | NO INFORMATION | NO INFORMATION | 0 | 0 | 1000 | 4000 | 2000 |
| | TRAY 701 | SORT | 500 | 500 | 1000 | 4000 | 2000 |
| | TRAY 700 | SORT | 2000 | 700 | 1700 | 4700 | 2700 |
| | | SINGLE STITCHING (NEAR SIDE) | 2000 | 1200 | 1200 | 4200 | 3200 |
| | | SINGLE STITCHING (FAR SIDE) | 2000 | 1200 | 4200 | 1200 | 2200 |
| | | DOUBLE STITCHING | 2000 | 1800 | 3800 | 2800 | 1800 |

FIG. 17

T2

| DISCHARGE DESTINATION | POST-PROCESSING MODE | C |
|---|---|---|
| UPPER TRAY | SORT | 0 |
| LOWER TRAY | SORT | 2 |
| | SINGLE STITCHING / DOUBLE STITCHING | 2 |

SHEET BUFFER APPARATUS, POST-PROCESSING APPARATUS, CONTROL METHOD, AND IMAGE FORMING APPARATUS

BACKGROUND OF THE INVENTION

1. Field of the Invention

The present invention relates to a post-processing apparatus having a buffer function of retaining a succeeding sheet while performing post-processing for a sheet having undergone image formation.

2. Description of the Related Art

There has been conventionally provided a system in which a post-processing apparatus (finisher) is connected downstream of an image forming apparatus such as a copying machine in the sheet conveyance direction of the image forming apparatus to perform post-processes such as stapling and punching. There is also proposed a post-processing apparatus which sequentially stacks sheets received from an image forming apparatus on an intermediate tray (to be referred to as a processing tray) arranged upstream of a stacking tray, and upon completion of stacking all sheets to form a booklet, performs post-processing such as stapling on the processing tray. A sheet bundle having undergone post-processing on the processing tray is discharged from the processing tray onto the stacking tray.

While performing post-processing (for example, stapling) for a preceding sheet bundle on the processing tray, some apparatuses overlay several succeeding sheets on the upstream side of the processing tray (to be referred to as buffering) to prevent the succeeding sheets from colliding with the sheet bundle during post-processing (Japanese Patent Laid-Open No. 9-48545). This arrangement in Japanese Patent Laid-Open No. 9-48545 prevents a decrease in image formation productivity when post-processing is executed. More specifically, in Japanese Patent Laid-Open No. 9-48545, a sheet is wound around a take-up roller arranged upstream of the processing tray for performing post-processing, and then the roller stops and waits. At the timing when a succeeding sheet arrives, the roller is driven again to overlay the wound sheet and the succeeding sheet. A predetermined number of sheets serving as a succeeding sheet bundle are overlaid, preventing discharge of the succeeding sheet bundle to the processing tray during execution of post-processing for a preceding sheet bundle on the processing tray. Post-processing can be done for a sheet bundle without widening the sheet conveyance interval in the image forming apparatus, and the productivity of the image forming apparatus does not decrease.

There is also proposed an apparatus which inhibits the buffering operation for a specific material and limiting the number of sheets to be overlaid in the buffering operation (U.S. Pat. No. 6,672,586). In U.S. Pat. No. 6,672,586, the buffering operation is inhibited or restricted for special sheets such as index paper, thick paper, and thin paper to prevent generation of a scratch or wrinkle of a sheet or generation of a jam owing to forced buffering of a special sheet.

A conventional post-processing apparatus executes buffering cancel processing. More specifically, when a buffering-inhibited sheet as disclosed in U.S. Pat. No. 6,672,586 is conveyed after a sheet capable of buffering, it temporarily waits till the end of post-processing for a preceding sheet bundle on the processing tray, and then the buffered sheet is discharged onto the processing tray. The image forming apparatus main body then discharges the buffering-inhibited sheet to the post-processing apparatus at a wider sheet interval between the buffering-inhibited sheet and a preceding one than that when a sheet is buffered. After that, the post-processing apparatus discharges the buffering-inhibited succeeding sheet onto the processing tray without buffering.

As a buffering arrangement, there has been conventionally proposed an arrangement which performs buffering by switch-back on a conveyance path, in addition to an arrangement which achieves buffering by take-up, as disclosed U.S. Pat. No. 6,672,586. In switch-back, after the trailing end of a sheet passes through the branch point between the conveyance path and a conveyance path for performing buffering, the sheet is conveyed in an opposite direction, guided to the buffering conveyance path by a path branch flapper or the like, and waits until the next sheet arrives. In apparatuses having these two exemplary arrangements, a sheet needs to be conveyed by a predetermined distance for buffering, and buffering itself takes a predetermined time. Depending on the post-processing time for a preceding sheet bundle and the productivity of the upstream image forming apparatus main body, the productivity may increase when it is controlled to convey sheets one by one without executing buffering, and discharge a succeeding sheet from the image forming apparatus main body in advance at a sheet interval corresponding to the processing time in sheet bundle processing on the processing tray.

Recently in the POD market, print jobs using various types of sheets coexistent in one bundle are frequently executed in form printing, transaction printing, and the like. The POD market requests high productivity. However, when performing the above-described operation, buffering processing is canceled in the overall image forming apparatus connected to the conventional post-processing apparatus, decreasing the productivity owing to the post-processing apparatus.

SUMMARY OF THE INVENTION

According to one aspect of the present invention, there is provided a sheet buffer apparatus which retains a sheet to be conveyed to a post-processing unit configured to perform post-processing for a sheet, the apparatus comprising: a buffer unit configured to perform buffer processing to retain a sheet to be conveyed to the post-processing unit and overlay the sheet to be retained and a succeeding sheet; a determination unit configured to determine whether a sheet is inhibited from the buffer processing by the buffer unit; and a control unit configured, when the determination unit determines that the sheet succeeding the sheet to be retained is a sheet for which the buffer processing is inhibited, to control the buffer unit not to perform the retaining of the sheet to be retained.

According to another aspect of the present invention, there is provided a post-processing apparatus which performs post-processing for a plurality of sheets received from an image forming unit, the apparatus comprising: sheet conveyance unit configured to convey a sheet received from the image forming unit, along a conveyance path; sheet stacking unit configured to stack a plurality of sheets conveyed by the sheet conveyance unit; post-processing unit configured to perform post-processing for a sheet bundle including the plurality of sheets stacked by the sheet stacking unit; buffer unit configured, arranged upstream of the sheet stacking unit, to retain one or more sheets up to a sheet of a predetermined number from a first sheet that form a next sheet bundle during the post-processing for the sheet bundle, and to overlay the one or more sheets retained and a succeeding sheet; acquisition unit configured to acquire sheet information for determining whether a sheet is inhibited from the buffer processing by the buffer unit; and control unit configured to control, based on the sheet information of an Nth sheet and the sheet information of an (N+1)th sheet out of the sheets of the predetermined number, whether to retain the Nth sheet.

According to another aspect of the present invention, there is provided a method of controlling a post-processing apparatus including sheet conveyance unit configured to convey, along a conveyance path, a sheet received from an image forming unit, sheet stacking unit configured to stack a plurality of sheets conveyed by the sheet conveyance unit, post-processing unit configured to perform post-processing for a sheet bundle stacked by the sheet stacking unit, and buffer unit configured temporarily to retain one or more sheets up to a sheet of a predetermined number from a first sheet that form a next sheet bundle during the post-processing by the post-processing unit for the sheet bundle, and to overlay and to buffer the one or more sheets retained and a succeeding sheet on a conveyance path of the sheet that extends to the sheet stacking unit from a position where the sheet is received from the image forming unit, the method comprising: an acquisition step of causing control unit of the post-processing apparatus to acquire sheet information about each sheet from the image forming unit; and a control step of causing the control unit of the post-processing apparatus to control retaining of a sheet by the buffer unit based on the sheet information, wherein in the control step, whether to retain an Nth sheet is controlled based on the sheet information of the Nth sheet and the sheet information of an (N+1)th sheet out of the sheets of the predetermined number.

When setting whether or not to buffer a sheet for a preceding sheet bundle, buffering is set by determining not only whether a succeeding sheet in a sheet bundle during post-processing can be buffered, but also whether even a second succeeding sheet can be buffered. Generation of cancelation of buffering processing can be prevented, preventing a decrease in productivity in a job in which various sheets are mixed and stacked.

Further features of the present invention will become apparent from the following description of exemplary embodiments (with reference to the attached drawings).

BRIEF DESCRIPTION OF THE DRAWINGS

FIGS. 13A and 13B are tables for explaining communication data;

FIG. 15 is a table for explaining a post-processing time acquisition table T1;

FIG. 17 is a table for explaining a buffer sheet counter acquisition table T2;

DESCRIPTION OF THE EMBODIMENTS

First Embodiment

The first embodiment of the present invention will now be described with reference to the accompanying drawings.

(Overall Arrangement and Basic Operation)

Figure 1:
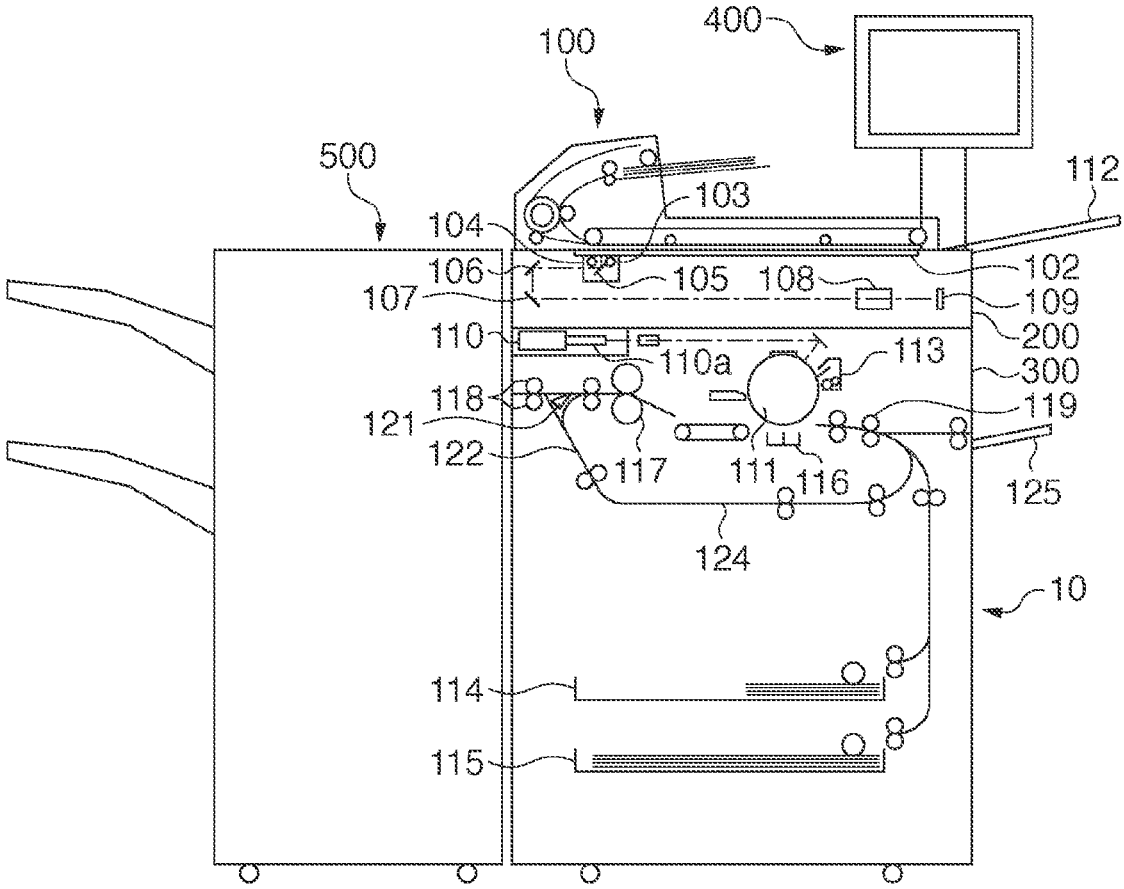
FIG. 1 is a sectional view showing the overall arrangement of a system.

FIG. 1 is a sectional view showing the overall arrangement of the main part of an image forming apparatus according to an embodiment of the present invention. As shown in FIG. 1, the image forming apparatus includes an image forming apparatus main body 10 serving as an image forming unit which performs image formation processing, and a finisher 500 serving as a post-processing unit. The image forming apparatus main body 10 includes an image reader 200 which reads a document image, and a printer 300. The finisher 500 is mounted to receive a document sent from the image forming apparatus main body 10.

A document feeder 100 is mounted on the image reader 200. The document feeder 100 feeds, one by one sequentially from the first page, document sheets which are set on a document tray to face up. The document feeder 100 conveys the document sheet from left to right via a feed reading position on a platen glass 102 through a curved path. The document feeder 100 then discharges the document sheet toward an external discharge tray 112.

When the document sheet passes through the feed reading position from left to right on the platen glass 102, a scanner unit 104 held at a position corresponding to the feed reading position reads the document image. This reading method is generally called document feed reading. More specifically, when a document sheet passes through the feed reading position, the reading surface of the document sheet is irradiated with light emitted by a lamp 103 of the scanner unit 104. The light reflected by the document sheet is guided to a lens 108 via mirrors 105, 106, and 107. The light having passed through the lens 108 forms an image on the image sensing surface of an image sensor 109.

By conveying a document sheet to pass through the feed reading position from left to right, document read scanning is performed. At this time, a direction perpendicular to the document conveyance direction serves as the main scanning direction, and the conveyance direction serves as the sub-scanning direction. More specifically, while the image sensor 109 reads a document image for each line in the main scanning direction when a document sheet passes through the feed reading position, the document sheet is conveyed in the sub-scanning direction, reading the entire document image. The image sensor 109 converts the optically read image into image data, and outputs the image data. The image data output from the image sensor 109 undergoes predetermined processing by an image signal control unit 922 (to be described later), and then is input as a video signal to an exposure control unit 110 of the printer 300.

Note that a document sheet may be conveyed on the platen glass 102 by the document feeder 100, stop at a predetermined position, and read by scanning the scanner unit 104 from left to right in this state, details of which will be omitted.

The exposure control unit 110 of the printer 300 modulates a laser beam based on the input video signal, and outputs it. The laser beam irradiates a photosensitive drum 111 while being scanned by a polygon mirror 110*a*. An electrostatic latent image corresponding to the scanned laser beam is formed on the photosensitive drum 111.

The electrostatic latent image on the photosensitive drum 111 is visualized as a developer image by a developer supplied from a developing unit 113. At a timing synchronized with the start of laser beam irradiation, a sheet is fed from one of cassettes 114 and 115, a manual feed unit 125, and a double-sided conveyance path 124.

When the fed sheet arrives at rollers 119, it temporarily stops. At the stop, a downstream apparatus (in this case, the finisher 500) is notified of sheet information of the stopped sheet via a communication means (to be described later). The sheet information contains the paper size, grammage, sheet material type, and post-processing mode. Upon receiving the sheet information notification from a CPU 901 of the image forming apparatus main body 10, a CPU 952 of the finisher 500 compares the paper size and post-processing mode of the temporarily stopped sheet with those of an immediately conveyed sheet, details of which will be described later. The CPU 952 of the finisher 500 calculates a post-processing time necessary in the finisher 500, and determines the interval between the temporarily stopped sheet and the preceding sheet. The CPU 952 of the finisher 500 notifies the CPU 901 of the image forming apparatus main body 10 of the sheet interval information. The CPU 901 of the image forming apparatus main body 10 stops the sheet at the rollers 119 until the sheet interval received from the CPU 952 of the finisher 500 elapses. Upon the lapse of the stop time, the sheet is conveyed between the photosensitive drum 111 and a transfer unit 116. The transfer unit 116 transfers, onto the fed sheet, the developer image formed on the photosensitive drum 111.

The sheet bearing the developer image is conveyed to a fixing unit 117. The fixing unit 117 thermally presses the sheet to fix the developer image onto the sheet. The sheet having passed through the fixing unit 117 passes through a flapper 121 and discharge rollers 118, and is discharged from the printer 300 toward the outside (finisher 500).

When discharging a sheet with its image forming surface facing down (face-down), the sheet having passed through the fixing unit 117 is temporarily guided to a reverse path 122 by the switching operation of the flapper 121. After the trailing end of the sheet passes through the flapper 121, the sheet is switched back and discharged from the printer 300 by the discharge rollers 118. This discharge form will be called reverse discharge. The reverse discharge is executed when forming images sequentially from the first page, for example, when forming images read using the document feeder 100 or when forming images output from a computer. The sheet order after discharge becomes a correct page order.

When double-sided printing is set to form images on the two surfaces of a sheet, the following control is done. More specifically, the sheet is guided to the reverse path 122 by the switching operation of the flapper 121, and conveyed to the double-sided conveyance path 124. The sheet guided to the double-sided conveyance path 124 is fed again to an interval between the photosensitive drum 111 and the transfer unit 116 at the above-mentioned timing. The sheet discharged from the printer 300 is sent to the finisher 500. The finisher 500 performs processes such as stitching.

(System Block Diagram)

Figure 2:
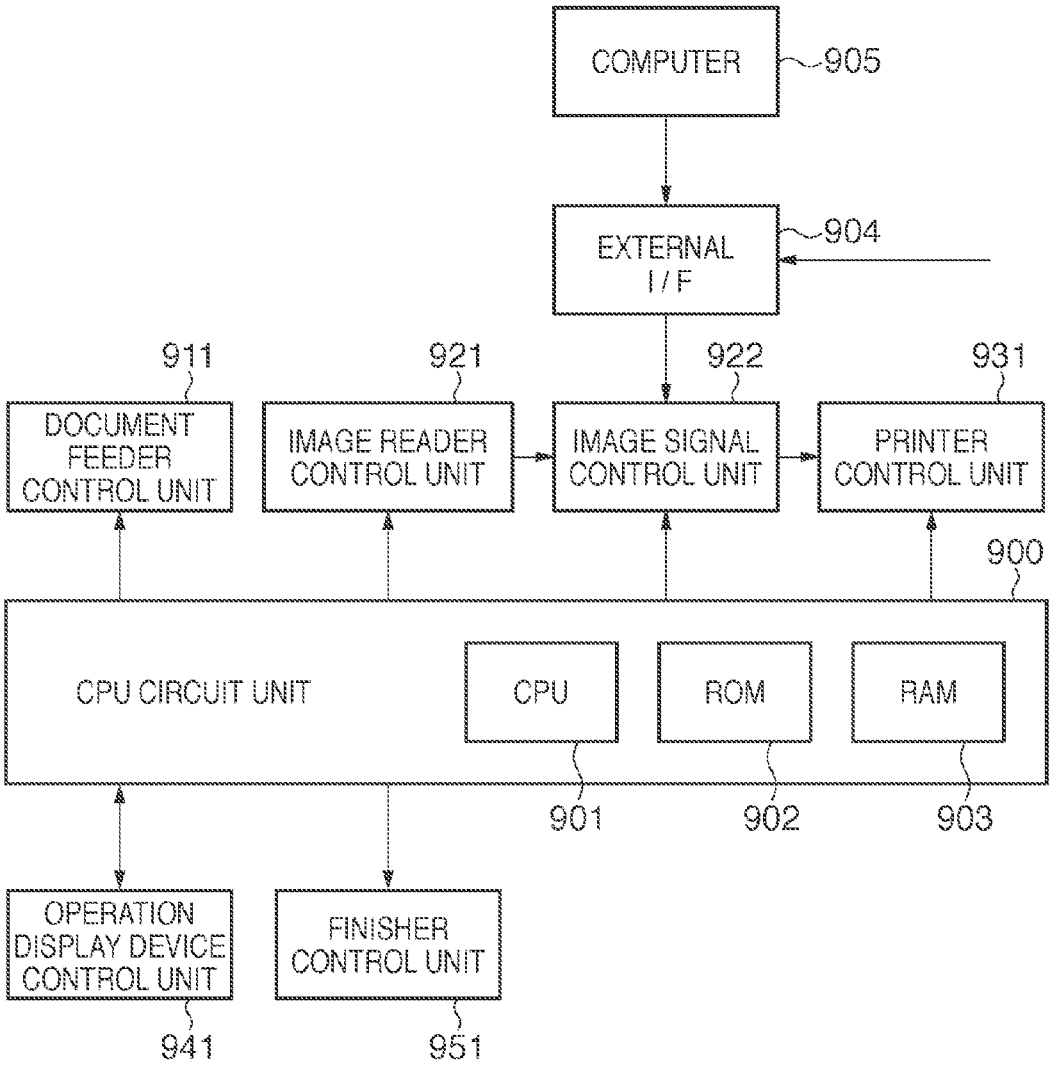
FIG. 2 is a block diagram showing the overall controller of the system.

The arrangement of a controller which controls the overall image forming apparatus will be explained with reference to FIG. 2. FIG. 2 is a block diagram showing the overall arrangement of the controller which controls the whole image forming apparatus in FIG. 1.

As shown in FIG. 2, the controller includes a CPU circuit unit 900. The CPU circuit unit 900 incorporates the CPU 901, a ROM 902, and a RAM 903. The CPU 901 comprehensively controls blocks shown in FIG. 2 based on control programs stored in the ROM 902. The RAM 903 temporarily holds control data, and is used as a work area for calculation processing accompanying control.

A document feeder control unit 911 controls driving of the document feeder 100 based on an instruction from the CPU circuit unit 900. An image reader control unit 921 controls driving the above-described scanner unit 104, image sensor 109, and the like, and transfers an analog image signal output from the image sensor 109 to the image signal control unit 922.

The image signal control unit 922 converts the analog image signal from the image sensor 109 into a digital signal, and performs processes for the digital signal. Further, the image signal control unit 922 converts the digital signal into a video signal, and outputs the video signal to a printer control unit 931. Also, the image signal control unit 922 performs various processes for a digital image signal which is input from a computer 905 via an external I/F 904, converts the digital image signal into a video signal, and outputs the video signal to the printer control unit 931. The CPU circuit unit 900 controls the processing operation of the image signal control unit 922. The printer control unit 931 drives the exposure control unit 110 based on the input video signal.

An operation display device control unit 941 exchanges information between an operation display device 400 and the CPU circuit unit 900. The operation display device 400 includes a plurality of keys for setting various functions regarding image formation, and a display unit for displaying information indicating a setting state. The operation display device 400 outputs a key signal corresponding to the operation of each key to the CPU circuit unit 900. Also, the operation display device 400 displays corresponding information on the display unit based on a signal from the CPU circuit unit 900.

A finisher control unit 951 is mounted in the finisher 500, and controls driving of the entire finisher by exchanging information with the CPU circuit unit 900. The control contents will be described later.

(Operation Display Device)

Figure 3:
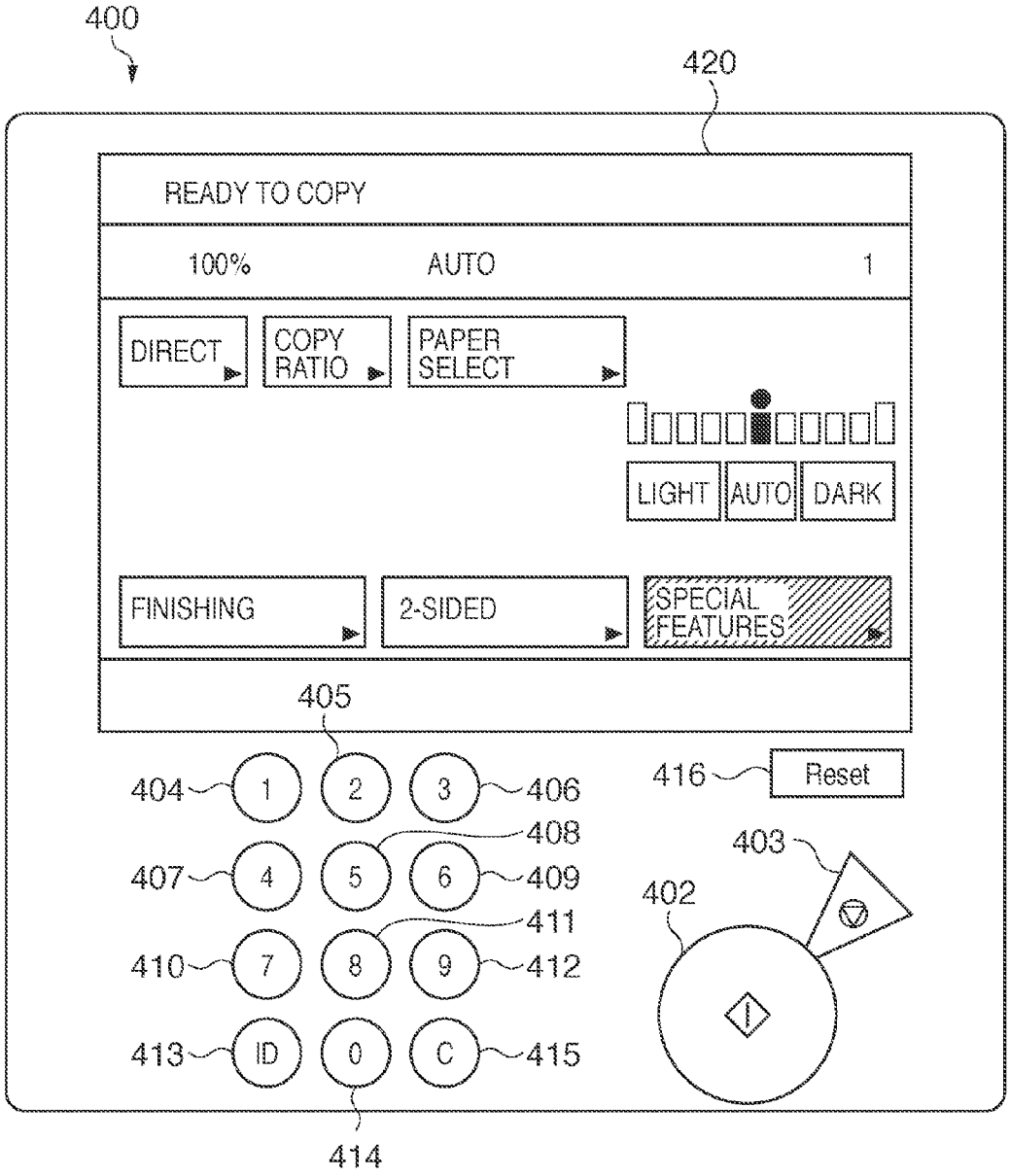
FIG. 3 is a view for explaining an operation display device.

FIG. 3 is a view showing the operation display device 400 in the image forming apparatus of FIG. 1. The operation display device 400 includes a start key 402 for starting an image forming operation, a stop key 403 for interrupting an image forming operation, ten keys 404 to 412 and 414 for performing entry setting and the like, an ID key 413, a clear key 415, and a reset key 416, and a user mode key (not shown) for setting various apparatuses. A display unit 420 having a surface formed from a touch panel is arranged, and can provide soft keys on the screen.

As post-processing modes, the image forming apparatus has various processing modes such as an unsorting mode, sorting mode, stapling mode (stitching mode), and bookbinding mode. The processing mode setting and the like are made by an input operation from the operation display device 400. For example, when setting the post-processing mode, a "finishing" soft key is selected on an initial screen shown in FIG.

3. Then, the display unit 420 displays a menu selection screen, and the processing mode is set using the menu selection screen.

(Finisher)

Figure 4:
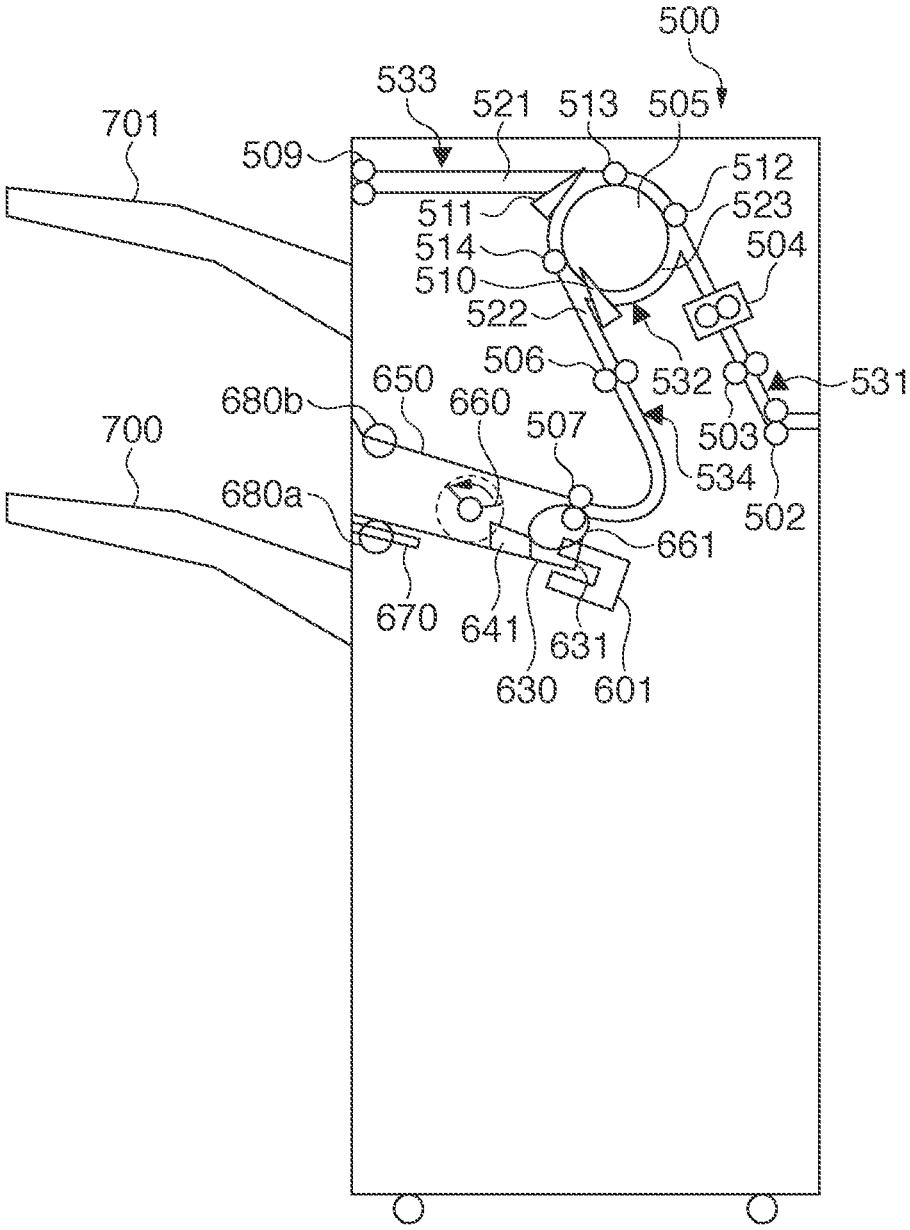
FIG. 4 is a sectional view showing a finisher.

The arrangement of the finisher 500 will be explained with reference to FIG. 4. FIG. 4 is a sectional view showing the arrangement of the finisher 500 in FIG. 1. The finisher 500 performs sheet post-processes such as processing of sequentially receiving sheets discharged from the image forming apparatus main body 10, and aligning the received sheets to bundle them into one, stapling processing of stapling the trailing ends of the bundled sheets, sorting processing, and unsorting processing.

The finisher 500 internally receives, via an inlet roller pair 502 driven by an inlet motor M1 (to be described later), a sheet discharged from the image forming apparatus main body 10. The sheet received into the inside by the inlet roller pair 502 is fed toward a buffer roller 505 via conveyance roller pairs 503 and 504 which are similarly driven by the inlet motor M1 (to be described later). A conveyance sensor 531 is arranged midway along a conveyance path between the inlet roller pair 502 and the conveyance roller pair 503, and detects the passage of a sheet.

A buffer motor M2 (to be described later) drives the buffer roller 505. The buffer roller 505 is a roller capable of winding and stacking, around its outer surface, a predetermined number of sheets conveyed via the conveyance roller pairs 503 and 504. A sheet is wound around the outer surface of the buffer roller 505 by press rollers 512, 513, and 514 during rotation. The wound sheet is conveyed in the rotational direction of the buffer roller 505. A switching flapper 511 which is driven by a solenoid S1 (to be described later) is interposed between the press rollers 513 and 514. A switching flapper 510 which is driven by a solenoid S2 (to be described later) is arranged downstream of the press roller 514. The buffer roller 505 is inserted in a conveyance path extending to a processing tray 630 from a position where a sheet is received from the image forming apparatus main body 10.

The switching flapper 511 separates a sheet wound around the buffer roller 505 from the buffer roller 505, and guides it to an unsorting path 521 or sorting path 522. The switching flapper 510 separates a sheet wound around the buffer roller 505 from the buffer roller 505, and guides it to the sorting path 522 or to a buffer path 523 while the sheet remains wound around the buffer roller 505.

When guiding a sheet wound around the buffer roller 505 to the unsorting path 521, the switching flapper 511 operates to separate the wound sheet from the buffer roller 505 and guide it to the unsorting path 521. The sheet guided to the unsorting path 521 is discharged onto a sample tray 701 via a conveyance roller pair 509 driven by a discharge motor M3 (to be described later). A conveyance sensor 533 is arranged midway along the unsorting path 521.

When guiding a sheet wound around the buffer roller 505 to the buffer path 523, neither the switching flapper 510 nor switching flapper 511 operates, and the sheet is sent to the buffer path 523 while being wound around the buffer roller 505. A conveyance sensor 532 is arranged midway along the buffer path 523 to detect a sheet on the buffer path 523. When guiding a sheet wound around the buffer roller 505 to the sorting path 522, not the switching flapper 511 but the switching flapper 510 operates to separate the wound sheet from the buffer roller 505 and guide it to the sorting path 522.

The sheet guided to the sorting path 522 is discharged onto the processing tray 630 serving as a sheet stacking means via the conveyance roller pairs 507 and 509 which are driven by the discharge motor M3 (to be described later). Sheets discharged in a bundle on the processing tray 630 are pulled back in a direction opposite to the conveyance direction by a knurled belt 661 which is driven in synchronization with the conveyance roller pair 509, and a paddle 660 which is driven by a paddle motor M7 (to be described later). The pulled-back sheets abut against a stopper 631 and stop.

Alignment members 641 arranged on the near and far sides on the processing tray 630 are moved by a pre-alignment motor M5 and post-alignment motor M6 in a direction perpendicular to the sheet conveyance direction, respectively. The alignment members 641 align sheets stacked on the processing tray 630. If necessary, sheets undergo stapling or the like, and then discharged onto a stack tray 700 by a discharge roller pair 680 made up of discharge rollers 680*a* and 680*b*.

A bundle discharge motor M4 (to be described later) drives the discharge roller pair 680, and a swing guide 650 supports the discharge roller 680*b*. The swing guide 650 is driven by a swing motor M8 (to be described later), and swings to make the discharge roller 680*b* abut against the top sheet on the processing tray 630. While the discharge roller 680*b* abuts against the top sheet on the processing tray 630, it can discharge a sheet bundle on the processing tray 630 toward the stack tray 700 in cooperation with the discharge roller 680*a*.

A retractable tray motor M11 (to be described later) drives a retractable tray 670. When stacking sheets on the processing tray 630, the retractable tray 670 projects up to prevent hanging, a return failure, and the like of a sheet P discharged by the conveyance roller pair 507, and improve the alignment of sheets on the processing tray 630.

A tray elevating motor M12 (to be described later) can move up and down the stack tray 700. A paper surface detection sensor 540 (to be described later) can detect the tray or the top surface of sheets on the tray. The tray elevating motor M12 is driven in accordance with an input from the paper surface detection sensor 540 to control the top surface to be always at a predetermined position. Note that the sample tray 701 is not movable up and down, unlike the stack tray 700, and is fixed at a position shown in FIG. 4.

A stapler 601 performs stapling processing. The stapler 601 is driven by a staple motor M9 (to be described later), and executes stitching processing. The stapler 601 stitches a sheet bundle stacked on the processing tray 630 at the back end position (trailing end) of the sheets in the sheet conveyance direction.

A stapler moving motor M10 (to be described later) can move the stapler 601 in a direction perpendicular to the conveyance direction along the outer surface of the processing tray 630. Before a sheet reaches the position, the stapler 601 moves in advance to a position corresponding to the designation of a stitching position set by the user.

(Finisher Block Diagram)

Figure 5:
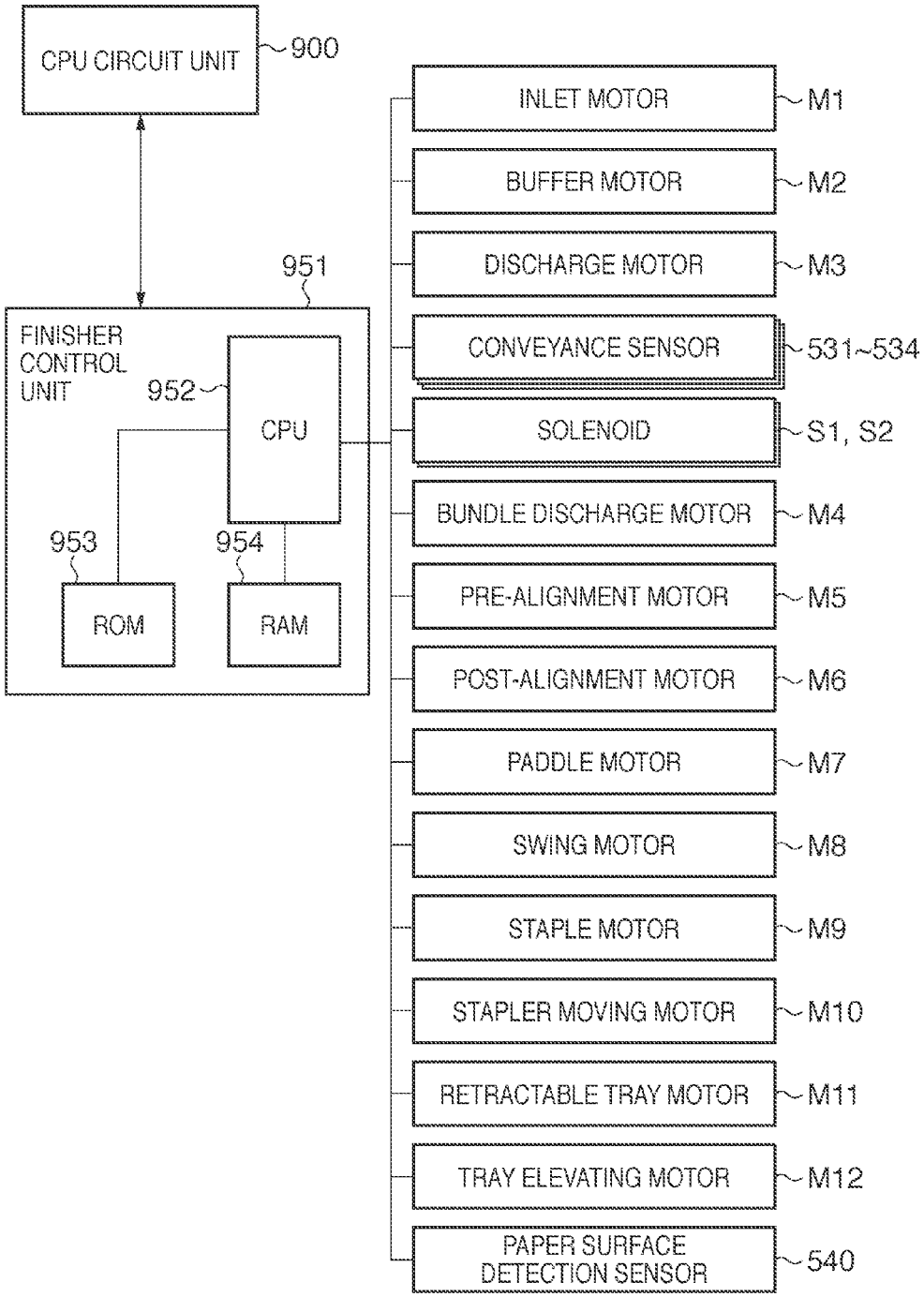
FIG. 5 is a block diagram showing the finisher.

The arrangement of the finisher control unit 951 which controls driving of the finisher 500 will be explained with reference to FIG. 5. FIG. 5 is a block diagram showing the arrangement of the finisher control unit 951 in FIG. 2. As shown in FIG. 5, the finisher control unit 951 includes the CPU 952, a ROM 953, and a RAM 954. The finisher control unit 951 communicates via a communication IC (not shown) with the CPU circuit unit 900 arranged in the image forming apparatus main body 10, and exchanges data such as job information and a sheet transfer notification. The finisher control unit 951 executes various programs stored in the ROM 953 based on an instruction from the CPU circuit unit 900, and controls driving of the finisher 500.

Various inputs and outputs of the finisher 500 will be explained. The finisher 500 includes the inlet motor M1, buffer motor M2, discharge motor M3, solenoid S1, solenoid S2, and conveyance sensors 531 to 534 for the above-described sheet conveyance. Also, the finisher 500 includes the bundle discharge motor M4, pre-alignment motor M5, post-alignment motor M6, paddle motor M7, swing motor M8, staple motor M9, stapler moving motor M10, retractable tray motor M11, tray elevating motor M12, and paper surface detection sensor 540 to perform post-processes such as sorting and stapling described above.

(Flow of Sheet)

The flow of a sheet in the finisher 500 will be explained for each of the unsorting, sorting, and stapling modes.

(Unsorting Operation)

Figure 10A:
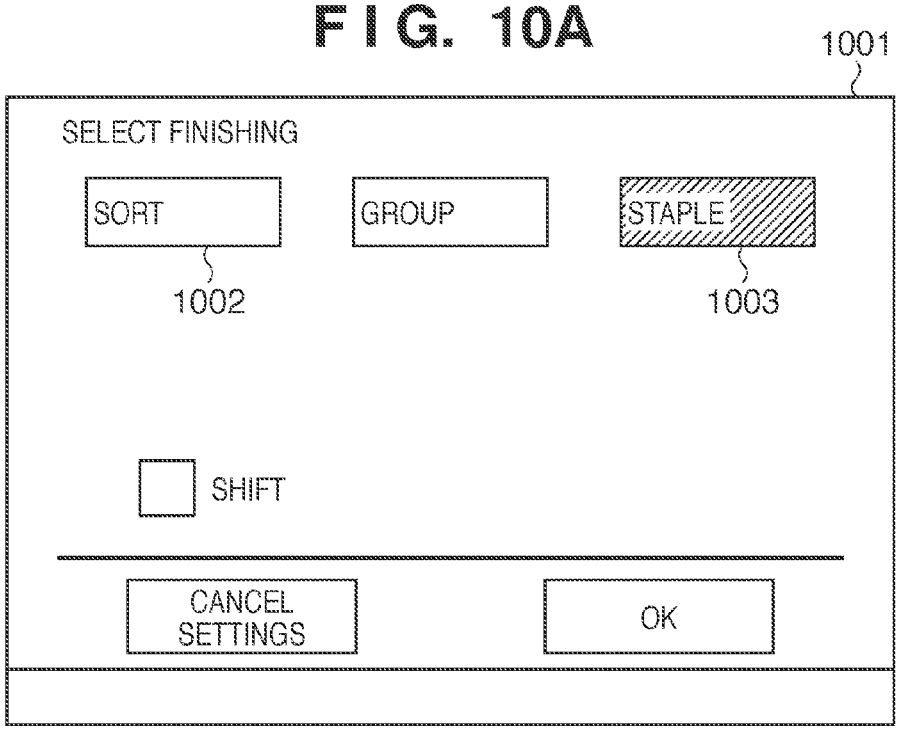
FIGS. 10A and 10B are views for explaining stapling mode setting.
Figure 10B:
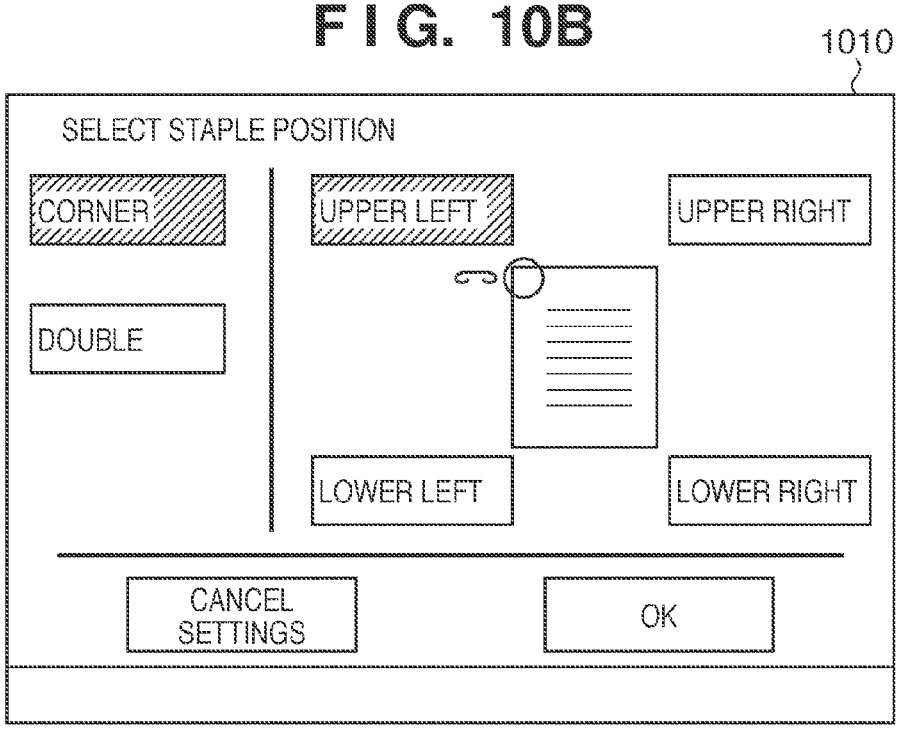

The flow of a sheet in the unsorting mode will be described with reference to FIGS. 3, 6, 10A, and 10B. When the user selects the "finishing" soft key on the initial screen shown in FIG. 3 on the operation display device 400 of the image forming apparatus main body 10, the display unit 420 displays a finishing menu selection screen 1001 as shown in FIG. 10A. If the user cancels selection of all soft keys in FIG. 10A and then ends selection of finishing, the unsorting mode is set.

When the user designates the unsorting mode and inputs a job, the CPU 901 of the CPU circuit unit 900 notifies the CPU 952 of the finisher control unit 951 of information about the job such as selection of the unsorting mode, in addition to information such as the sheet size.

When discharging the sheet P from the image forming apparatus main body 10 to the finisher 500, the CPU 901 of the CPU circuit unit 900 notifies the CPU 952 of the finisher control unit 951 to start transfer of the sheet. Control of various inputs and outputs in the finisher 500 by the CPU 952 will be explained.

Figure 6:
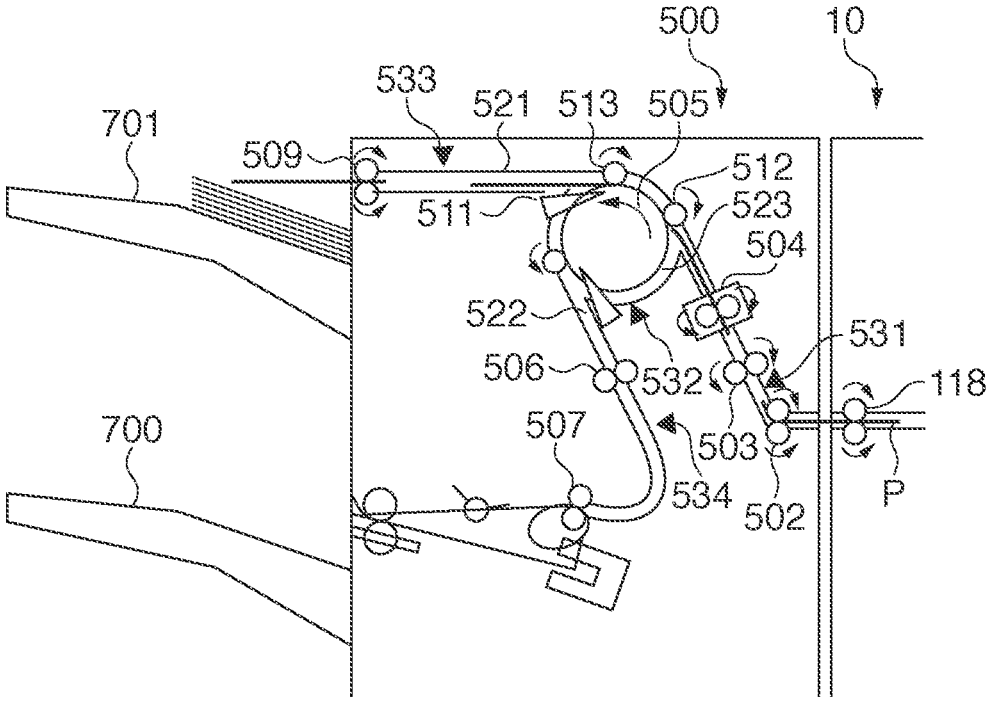
FIG. 6 is a sectional view for explaining an unsorting operation.

Upon receiving the sheet transfer start notification, the CPU 952 drives the inlet motor M1, buffer motor M2, and discharge motor M3 to drive the inlet roller pair 502, conveyance roller pairs 503 and 504, buffer roller 505, and conveyance roller pair 509 to rotate, as shown in FIG. 6. The sheet P discharged from the image forming apparatus main body 10 is supplied into the finisher 500 and conveyed.

The solenoid S1 drives the switching flapper 511 to rotate to a position shown in FIG. 6. The sheet P is guided to the unsorting path 521 without buffering it by the buffer roller 505. When the conveyance sensor 533 detects the trailing end of the sheet P, the speed of the discharge motor M3 is changed to rotate the conveyance roller pair 509 at a speed suited to stacking, and the sheet P is discharged onto the sample tray 701.

(Sorting Mode Operation)

The flow of a sheet in the sorting mode will be described with reference to FIGS. 7A to 7C, 10A, and 10B, and the flowchart of FIG. 11. When the user ends selection of finishing while selecting a "sort" soft key 1002 on the finishing menu selection screen shown in FIG. 10A, the sorting mode is set. When the user designates the sorting mode and inputs a job, the CPU 901 of the CPU circuit unit 900 notifies the CPU 952 of the finisher control unit 951 that the sorting mode is selected, similar to the unsorting mode.

An operation in the sorting mode when the number of sheets which form one "copy" serving as one sheet bundle is three will be explained. First, a case in which "pass" is set as the buffer mode of each sheet in accordance with the setting of a buffering operation mode (to be referred to as a buffer mode) by the CPU 952 (to be described later) will be described. When discharging the sheet P from the image forming apparatus main body 10 to the finisher 500, the CPU 901 of the CPU circuit unit 900 notifies the CPU 952 of the finisher control unit 951 to start transfer of the sheet. Control of various inputs and outputs in the finisher 500 by the CPU 952 will be explained.

Figure 7A:
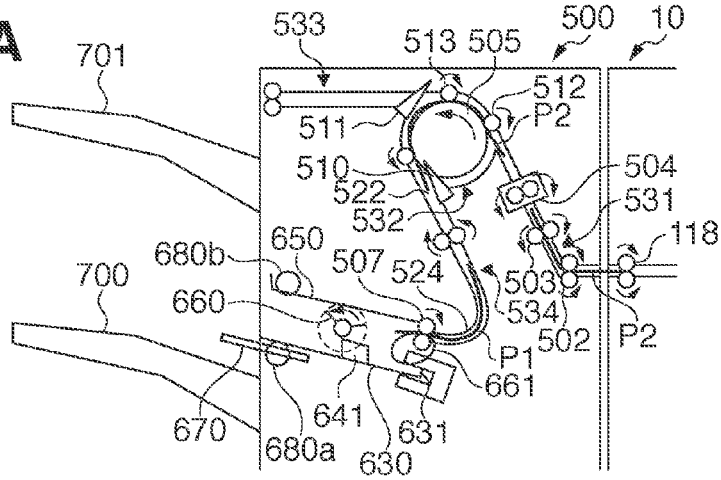
FIGS. 7A, 7B, and 7C are sectional views for explaining a sorting operation.

Upon receiving the sheet transfer start notification, the CPU 952 drives the inlet motor M1 and buffer motor M2, thereby driving the inlet roller pair 502, conveyance roller pairs 503 and 504, and buffer roller 505 to rotate, as shown in FIG. 7A. The sheet P discharged from the image forming apparatus main body 10 is supplied into the finisher 500 and conveyed. At this time, each sheet is conveyed without buffering it by the buffer roller 505.

Figure 11:
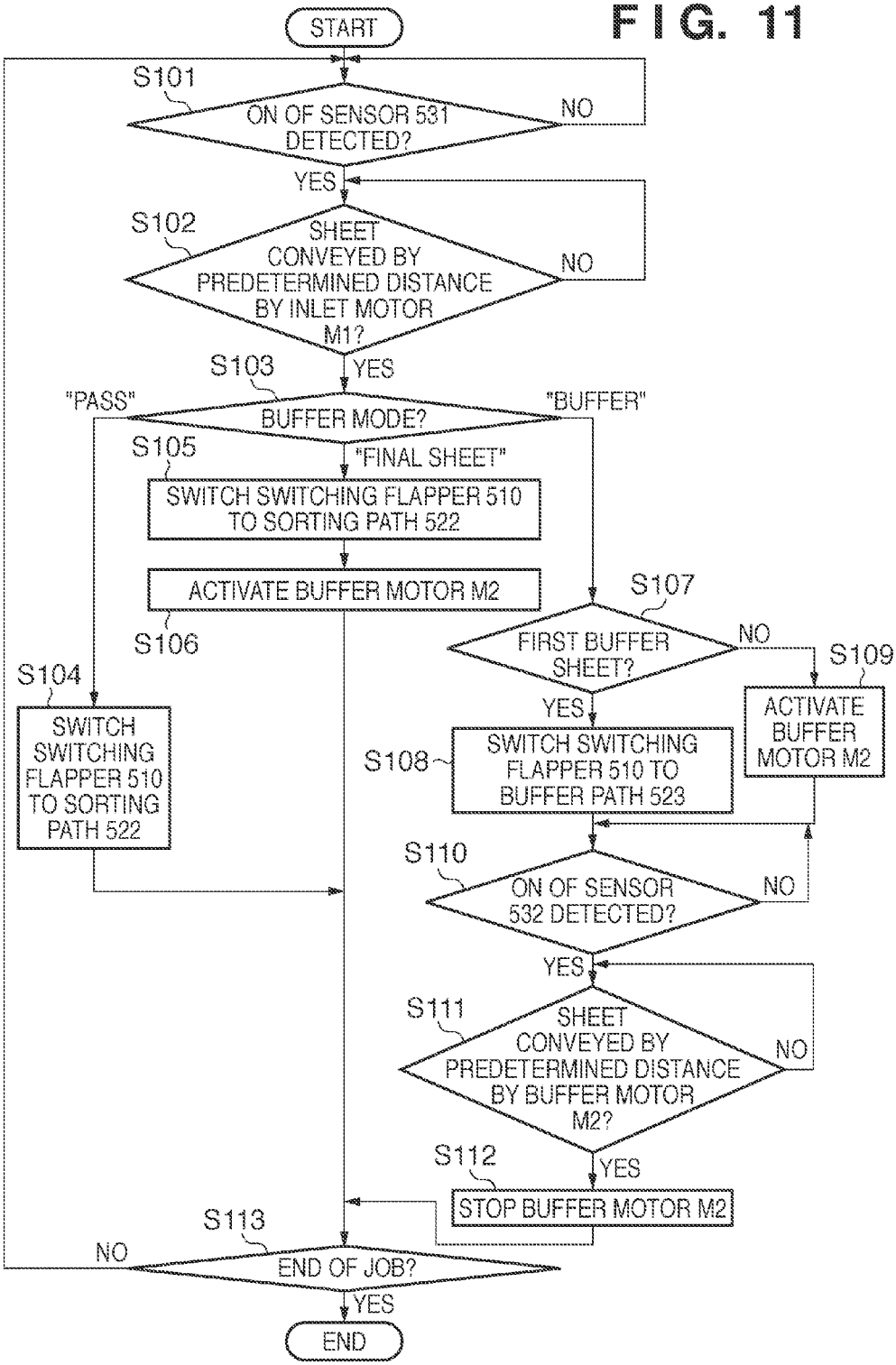
FIG. 11 is a flowchart showing a buffer control operation by a CPU 952.

FIG. 11 is a flowchart showing the sequence of a buffering operation (to be referred to as a buffer operation) by the CPU 952. If the CPU 952 detects the ON operation of the conveyance sensor 531 (YES in step S101), it controls the inlet motor M1 to convey the sheet P by a predetermined distance (YES in step S102), and then advances to step S103.

If the buffer mode is "pass" in step S103, the switching flapper 510 is positioned in step S104 to guide the sheet to the sorting path 522, as shown in FIG. 7A. If the job continues (NO in step S113), the process returns to step S101 to keep the sheet retained until the next sheet arrives, and wait until the sheet is guided.

The switching flapper 511 is also set at a position shown in FIG. 7A, and a sheet P1 is guided to the sorting path 522. The sheet P guided to the sorting path 522 is discharged onto the processing tray 630 by the conveyance roller pairs 506 and 507. When the conveyance sensor 534 detects that the sheet P has advanced by a predetermined distance after detecting the trailing end of the sheet P, the CPU 952 detects that the sheet P1 has been discharged onto the processing tray 630.

The sheet P1 discharged on the processing tray 630 starts moving first by its weight toward the stopper 631 on the processing tray 630. Biasing members such as the paddle 660 and knurled belt 661 bias the movement of the sheet P. When the trailing end of the sheet P1 abuts against the stopper 631 and the sheet P1 stops, the alignment members 641 align the discharged sheet. In the same way, sheets P2 and P3 are stacked on the processing tray 630.

Figure 7B:
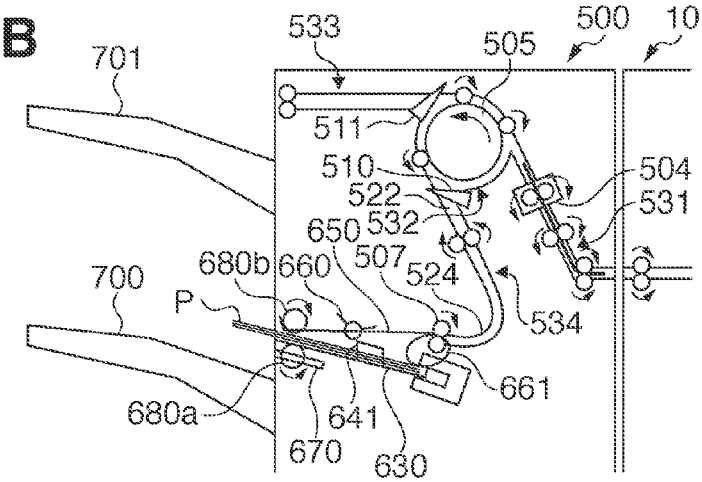
Figure 7C:
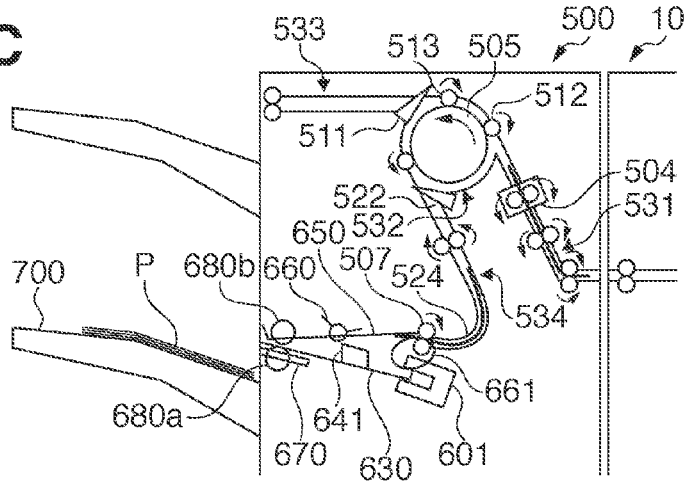

Thereafter, the swing motor M8 is driven to move down the swing guide 650, as shown in FIG. 7B. The discharge rollers 680*a* and 680*b* clamp the sheet bundle P to perform a bundle discharge operation, discharging the sheet bundle P onto the stack tray 700. In each sheet bundle, sheets are stacked upward in the page order so that their image forming surfaces face down and the first page is located at the bottom. These sheets are sequentially stacked on the stack tray 700 (FIG. 7C).

A buffer operation when the buffer mode is set to "buffer" for the sheets P1 and P2 and "final sheet" for the sheet P3 succeeding the sheet P2 will be explained with reference to FIGS. 8A to 8D and the flowchart of FIG. 11.

In FIG. 11, if the CPU 952 detects the ON operation of the conveyance sensor 531 for the sheet P1 (YES in step S101), and the inlet motor M1 conveys the sheet P1 by a predetermined distance (YES in step S102), the process advances to step S103.

Figure 8A:
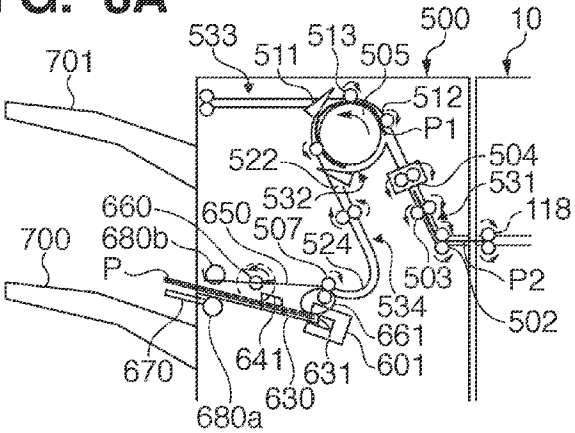
FIGS. 8A, 8B, 8C, and 8D are sectional views for explaining a sorting operation for the second and subsequent copies.
Figure 8B:
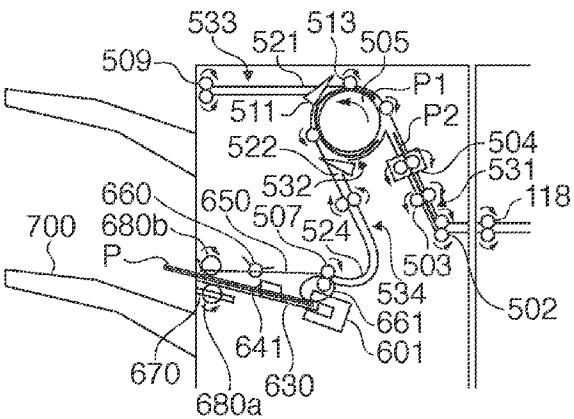

In step S103, the buffer mode of the sheet P1 is determined. Since the buffer mode is "buffer", the process advances to step S107. The sheet P1 is the first buffer sheet (YES in step S107), so the switching flapper 510 is switched to the buffer path 523 as shown in FIG. 8A (step S108). If the ON operation of the conveyance sensor 532 is detected (YES in step S110) and the buffer motor M2 conveys the sheet P1 by a predetermined distance (YES in step S111), the buffer motor stops (step S112). To buffer the sheet P1 and overlay the succeeding sheet P2 on it, as shown in FIG. 8B, the sheet P1 stops while being wound around the buffer roller 505, and waits until the sheet P2 arrives. That is, the sheet is retained on a predetermined conveyance path until one or more succeeding sheets arrive.

If the CPU 952 similarly detects the ON operation of the conveyance sensor 531 for the sheet P2 (YES in step S101), and the inlet motor M1 conveys the sheet P2 by a predetermined distance (YES in step S102), the process advances to step S103.

Figure 8C:
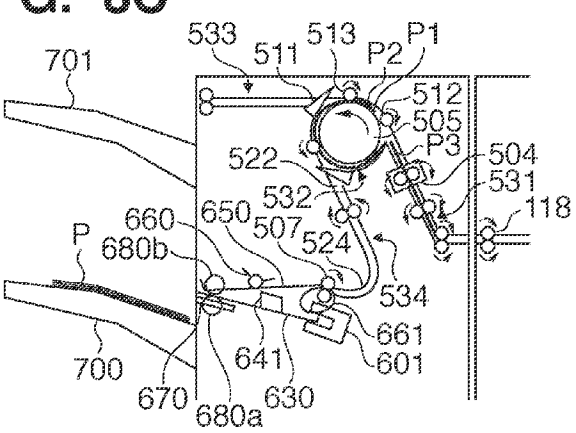

Since the buffer mode of the sheet P2 is also "buffer", similar to the sheet P1, the process advances to step S107. The sheet P2 is the second buffer sheet in step S107 (NO in step S107), so the process advances to step S109. In step S109, the buffer motor M2 is activated to rotate the buffer roller 505 and overlay the sheets P1 and P2 on the buffer roller 505. If the ON operation of the conveyance sensor 532 is detected (YES in step S110) and the buffer motor M2 conveys the sheet P2 by a predetermined distance (YES in step S111), the buffer motor stops (step S112). As a result, the sheets P1 and P2 stop while being wound around the buffer roller 505, as shown in FIG. 8C.

Figure 8D:
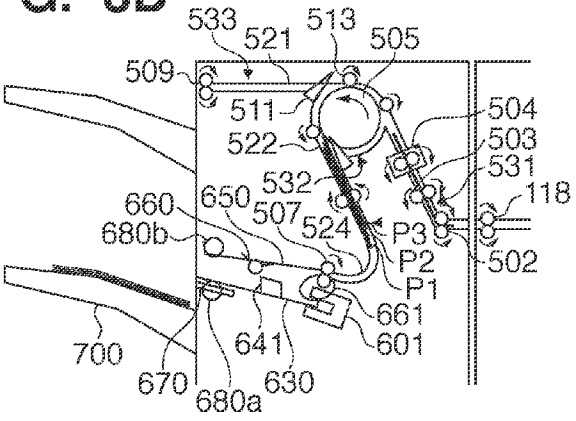

Next, the flow of the sheet P3 when the buffer mode is "final sheet" will be explained. If the CPU 952 detects the ON operation of the conveyance sensor 531 for the sheet P3 (YES in step S101), the inlet motor M1 conveys the sheet P2 by a predetermined distance (YES in step S102). The switching flapper 510 is switched to guide the sheet to the sorting path 522, as shown in FIG. 8D (step S105). In step S106, the buffer motor M2 is activated to start rotating the buffer roller 505. As a result, the next sheet P3 is overlaid on the sheets P1 and P2 which are unwound from the buffer roller 505. The sheets are then conveyed to the sorting path 522, as shown in FIG. 8D.

At this time, the bundle discharge operation of the sheet bundle P stacked on the processing tray 630 has ended, and the processing tray 630 can accept sheets. The sheet bundle P is discharged onto the processing tray 630. As described above, sheets up to a sheet of a predetermined number (in this processing sequence, a sheet immediately preceding the final sheet) from the first sheet in each sheet bundle are temporarily buffered. After the final sheet arrives, a discharge operation is done for the entire bundle formed from one or more buffered sheets and the final sheet.

If the fourth and subsequent sheets exist, they are discharged onto the processing tray 630 through the sorting path 522, similar to the sheet discharge operation for the bundle of the first copy. The same operation is repetitively executed for sheet bundles of the next and subsequent copies after the sheet bundle of the second copy is discharged onto the stack tray 700. Accordingly, a preset number of sheet bundles are stacked on the stack tray 700.

(Stapling Mode Operation)

The flow of a sheet in the stapling mode will be explained with reference to FIGS. 9A to 9D, 10A, and 10B. When the user presses a "staple" soft key 1003 on the finishing menu selection screen as shown in FIG. 10A, the display unit 420 displays a stapling setting screen 1010 shown in FIG. 10B. In this display, the user can select a stitching method such as corner stitching or double stitching.

When the user sets the stapling mode, the CPU 901 of the CPU circuit unit 900 notifies the CPU 952 of the finisher control unit 951 that the stapling mode has been selected, similar to the sorting mode. The CPU 952 controls various inputs and outputs in the finisher 500 to sequentially stack sheets on the processing tray 630, similar to the flow of sheets in the sorting mode described above (FIG. 9A).

Figure 9A:
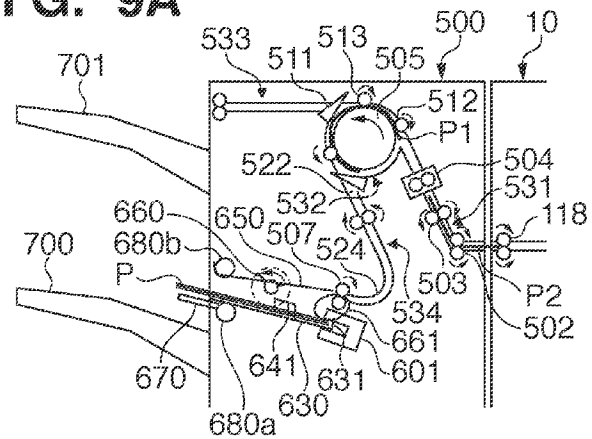
FIGS. 9A, 9B, 9C, and 9D are sectional views for explaining a stapling/sorting operation.
Figure 9B:
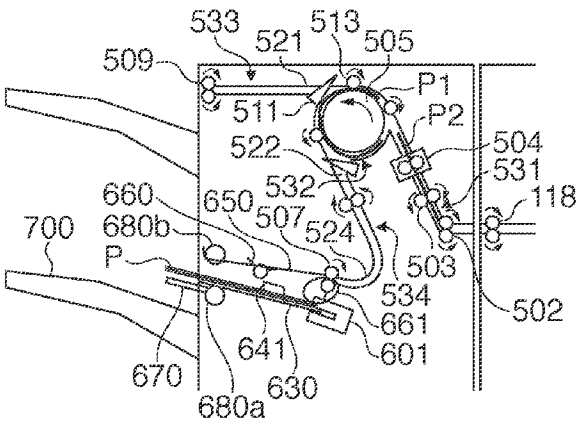
Figure 9C:
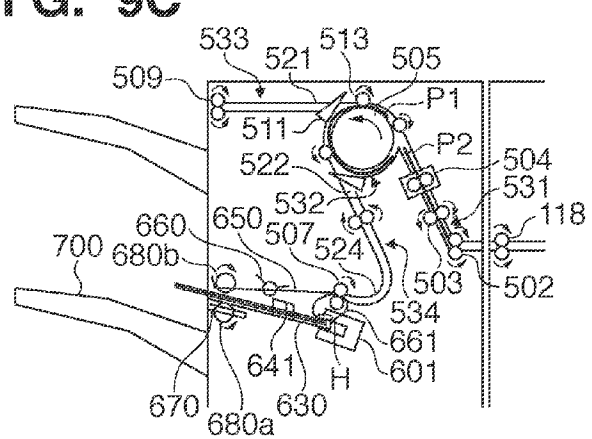

After all sheets which form one booklet are stacked on the processing tray 630, and alignment processing by the alignment members 641 is completed for the finally stacked sheet, as shown in FIG. 9B, the staple motor M9 is driven to stitch the sheet bundle by the stapler 601. Note that the sheet bundle P is stitched by a staple H at the trailing end in the conveyance direction, as shown in FIG. 9C.

Figure 9D:
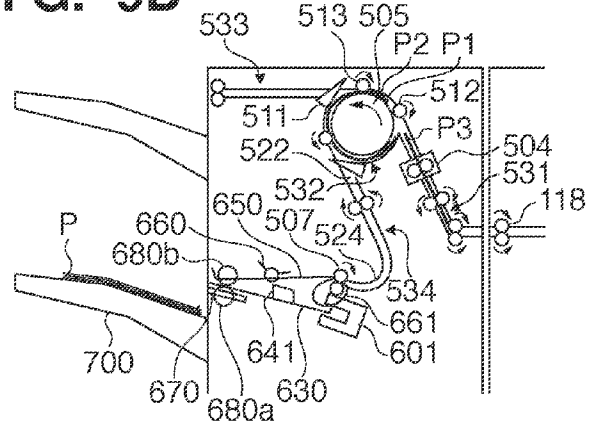

Upon completion of the stitching operation by the stapler 601, the swing motor M8 is driven to move down the swing guide 650. The discharge rollers 680*a* and 680*b* clamp the sheet bundle P to perform a bundle discharge operation, discharging the sheet bundle P onto the stack tray 700 (FIG. 9D). Similar to the sorting mode operation, while the sheet bundle P undergoes stapling processing on the processing tray 630, a subsequent sheet is wound around the buffer roller 505 (FIG. 9D). By buffering the next sheet bundle during post-processing for the preceding sheet bundle, stapling processing (post-processing) can be executed without decreasing the productivity.

(Notification of Sheet Information and Control of Sheet Interval)

Figure 12:
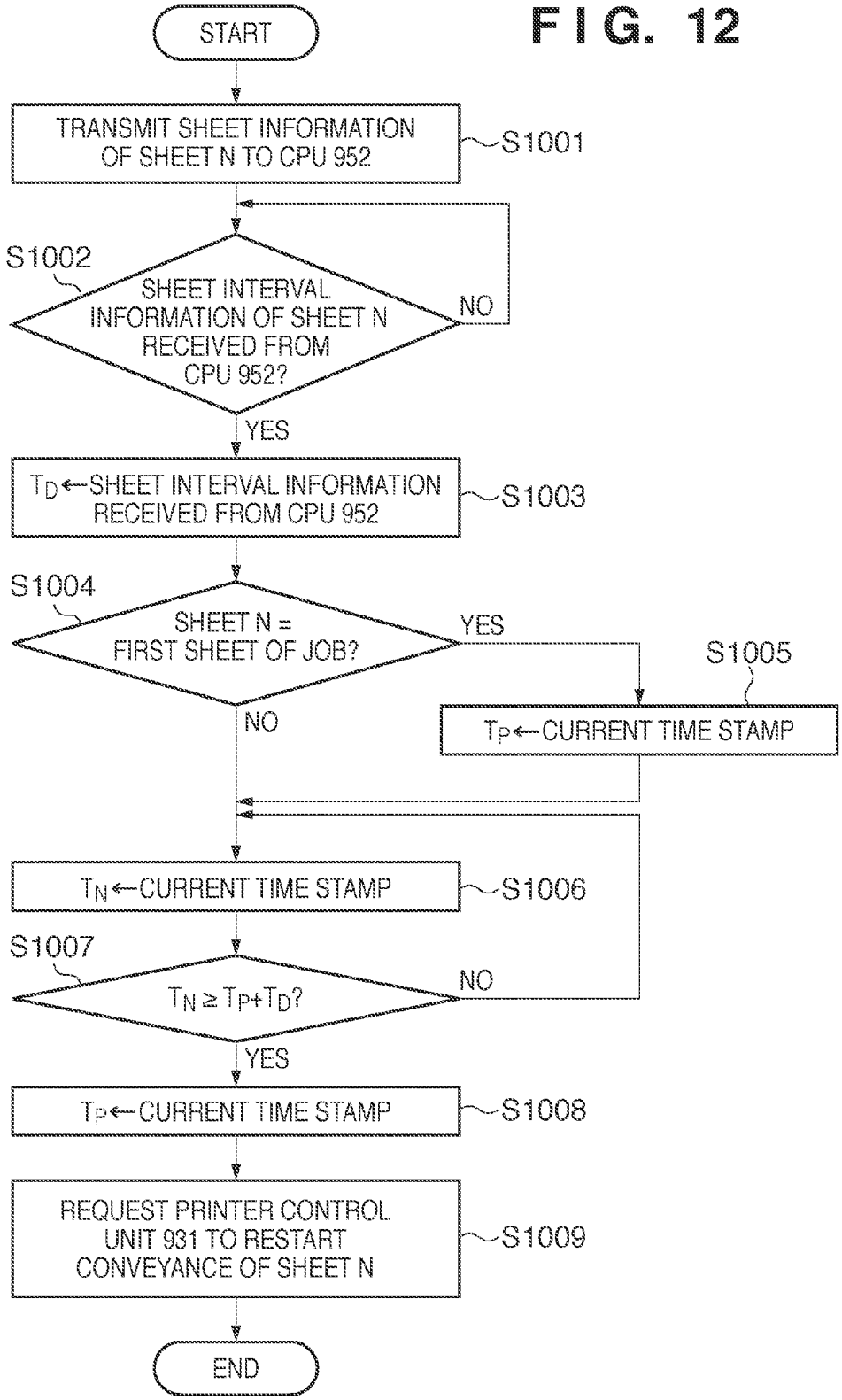
FIG. 12 is a flowchart showing sheet interval control by a CPU 901.

Control of the discharge interval of a sheet from the image forming apparatus main body 10 by the CPU 901 of the image forming apparatus main body 10 will be explained with reference to the flowchart of FIG. 12 and FIGS. 13A and 13B. As described above, when a sheet fed from the cassette 114 or the like arrives at the rollers 119, the printer control unit 931 temporarily stops the sheet in accordance with an instruction from the CPU 901. FIG. 12 is a flowchart showing a sequence when the CPU 901 determines the sheet interval at the time of the stop at the rollers 119. Processing by the CPU 901 will be described, unless otherwise specified. For descriptive convenience, the Nth sheet and (N+1)th sheet out of successive sheets will be referred to as sheet N and sheet N+1.

In step S1001, the CPU 901 of the image forming apparatus main body 10 notifies the CPU 952 of the finisher 500 of sheet information of sheet N via the communication IC (not shown). FIG. 13A shows the format of the sheet information notification. This sheet information format defines sheet information for each sheet. In this format, information necessary to determine buffer capability (to be described later) for sheet N+1 succeeding sheet N is also added to information of sheet N. In the embodiment, the paper length, paper width, grammage, sheet material type, and post-processing mode (post-processing type) of sheet N+1 are attached. The "standard sheet interval time" in the sheet information notification is a time calculated from the productivity in the image forming apparatus main body 10. For example, when forming images on 120 sheets per min at equal intervals, the standard sheet interval time is 500 [msec]. This standard sheet interval time is calculated by the CPU 901 and attached to the sheet information notification. Note that this information may be defined in advance in accordance with the apparatus specifications.

In step S1002, the CPU 901 waits until it receives sheet interval information of sheet N from the CPU 952 of the finisher 500. Transmission of the sheet interval information from the CPU 952 will be described later. If the CPU 901 receives the sheet interval information from the CPU 952 (YES in step S1002), it advances to step S1003. FIG. 13B shows the format of the sheet interval information received from the CPU 952.

In step S1003, the CPU 901 substitutes the "necessary sheet interval time" of the sheet interval information notification received from the CPU 952 into a variable $T_D$ set in the RAM 903. In step S1004, the CPU 901 determines whether sheet N is the first sheet of the job. If sheet N is the first sheet of the job (YES in step S1004), the CPU 901 saves a time stamp at that time in a variable $T_P$ in the RAM 903 (step S1005). If sheet N is the first sheet of the job, there is no sheet interval time from a preceding sheet. Instead, $T_P$ is set to wait for a time ($=T_D$) necessary for acceptance preparation in the finisher 500.

In step S1006, the CPU 901 saves the current time stamp in a time variable $T_N$ in the RAM 903. The CPU 901 waits until $T_N \geq T_P+T_D$ holds (step S1007). $T_P+T_D$ indicates time when the necessary sheet interval time $T_D$ elapses after time $T_P$ when conveyance of preceding sheet N−1 by the rollers 119 starts. That is, when the rollers 119 start conveyance after waiting until $T_N \geq T_P+T_D$ holds, a sheet interval time of $T_D$ or more is ensured between sheets N−1 and N.

If $T_N \geq T_P+T_D$ holds (YES in step S1007), the CPU 901 saves a time stamp at that time in $T_P$ (step S1008), and advances to step S1009. In step S1009, the CPU 901 requests the printer control unit 931 to restart conveyance of sheet N, and the printer control unit 931 controls the rollers 119 to restart conveyance of sheet N.

(Buffer Information Setting)

A sequence when the CPU 952 of the finisher 500 notifies the CPU 901 of a sheet interval information notification based on the contents of the sheet information notification of sheet N that has been received from the CPU 901 of the image forming apparatus main body 10 will be explained with reference to the flowchart of FIG. 14 and FIG. 15. Processing by the CPU 952 will be described, unless otherwise specified.

In step S1101, the CPU 952 waits until the CPU 901 notifies it of sheet information of sheet N. Upon receiving the sheet information notification, the CPU 952 saves the sheet information in the RAM 954, and advances to step S1102. In step S1102, the CPU 952 substitutes standard sheet interval time information of the received sheet information of sheet N into a variable $I_N$ set in the RAM 954.

In step S1103, the CPU 952 clears, to 0, a necessary sheet interval time D serving as a variable in the RAM 954, and advances to step S1104. If the CPU 952 determines in step S1104 that sheet N is the first sheet of a "copy" serving as the unit of a product (YES in step S1104), it advances to step S1105. In step S1105, the CPU 952 looks up a post-processing time table T1 shown in FIG. 15 based on pieces of sheet information of sheets N and N−1, and substitutes a post-processing time acquired from the table T1 into a variable $T_B$ in the RAM 954.

The post-processing time table T1 in FIG. 15 is used to acquire a time necessary between sheets N−1 and N, that is, the sum of a time necessary for post-processing of sheet N−1 and a time necessary for preparation (for example, movement of the stapler 601 to an initial position) to perform post-processing for sheet N. For example, when the discharge destination is "tray 700" and the post-processing mode is "single stitching (near side)" for both sheets N−1 and N, 1,200 [msec] is substituted into $T_B$. When sheet N is the first sheet of the job, no sheet N−1 exists, the discharge destination of sheet N is "tray 700", and the mode is "double stitching", 2,000 [msec] is substituted into $T_B$ as the preparation time for receiving sheet N. Assume that the post-processing time table T1 is defined in advance in accordance with the apparatus specifications.

In step S1105, the CPU 952 acquires the post-processing time and then advances to step S1106 to perform processing $F_A$. In processing $F_A$, the buffer mode is set and the necessary sheet interval time is calculated for the first sheet of a "copy", details of which will be described later. The necessary sheet interval time is a sheet interval time between sheets N−1 and N. The necessary time changes depending on execution/no execution of the buffer operation for sheet N in addition to the post-processing contents of sheets N−1 and N.

If the CPU 952 determines in step S1104 that sheet N is not the first sheet of a "copy" (NO in step S1104), it advances to step S1107 to perform processing $F_B$. In processing $F_B$, the buffer mode is set and the necessary sheet interval time is calculated when sheet N is not the first sheet of a "copy", details of which will be described later.

After processing $F_A$ in step S1106 or processing $F_B$ in step S1107, the CPU 952 determines in step S1108 whether the necessary sheet interval time D calculated in processing $F_A$ or processing $F_B$ is larger than $I_N$. If the necessary sheet interval time D is equal to or larger than $I_N$ (NO in step S1108), the CPU 952 advances to step S1109. If the necessary sheet interval time D is smaller than $I_N$ (YES in step S1108), the CPU 952 substitutes $I_N$ into D (step S1111), and advances to step S1109.

In step S1109, the CPU 952 sets the value D in the necessary sheet interval time of the sheet interval information notification, and transmits the sheet interval information notification to the CPU 901 via the communication IC (not shown). Thereafter, the CPU 952 advances to step S1110, and if it determines to continue the job (NO in step S1110), returns to step S1101.

(Setting of Buffer Mode/Calculation of Necessary Sheet Interval Time: First Sheet)

Figure 16:
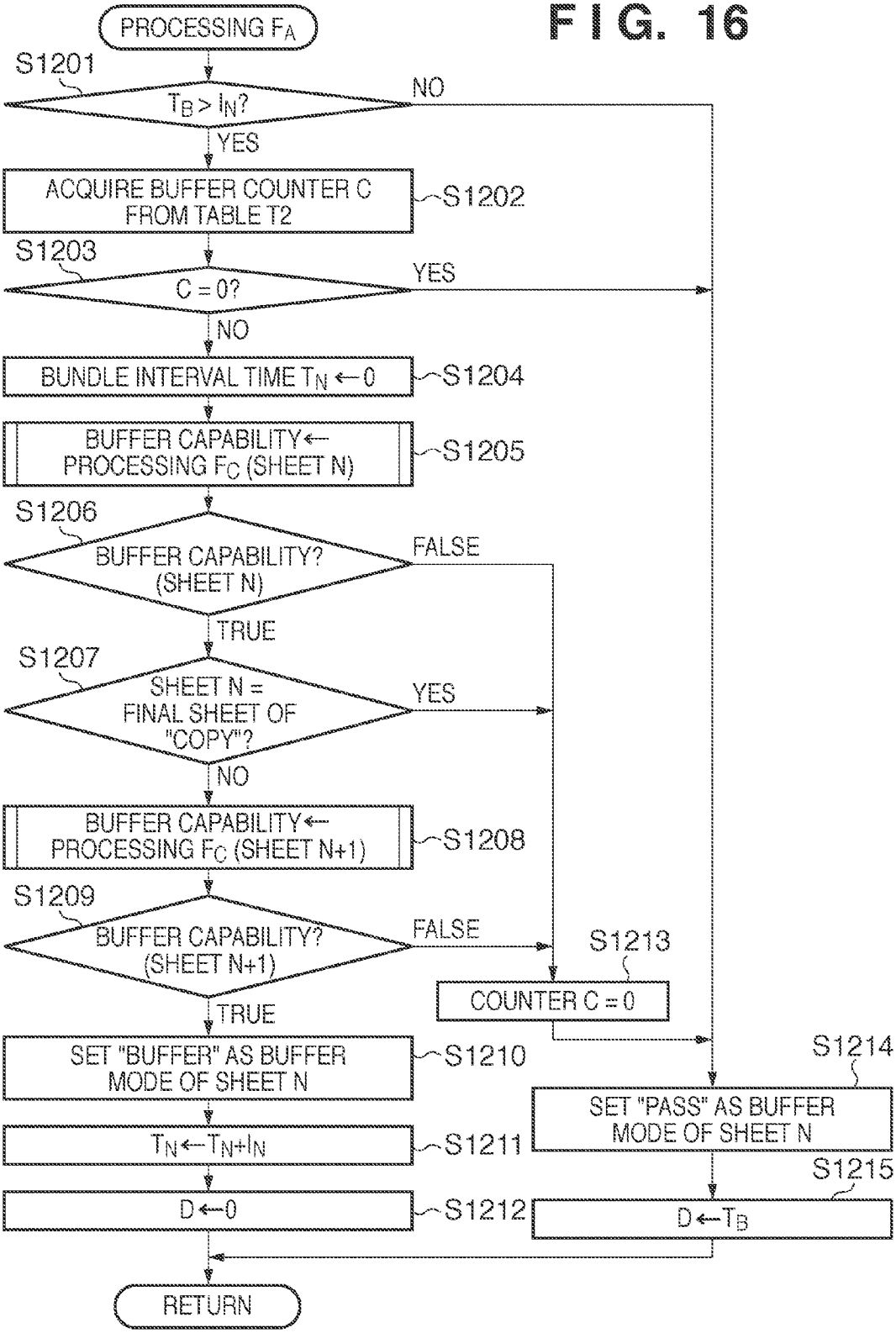
FIG. 16 is a flowchart when the CPU 952 determines a buffer mode.

A sequence when the CPU 952 sets a buffer mode for the first sheet of a "copy" and calculates the necessary sheet interval time in processing $F_A$ will be explained with reference to the flowchart of FIG. 16 and FIG. 17. Processing by the CPU 952 will be described, unless otherwise specified.

Figure 14:
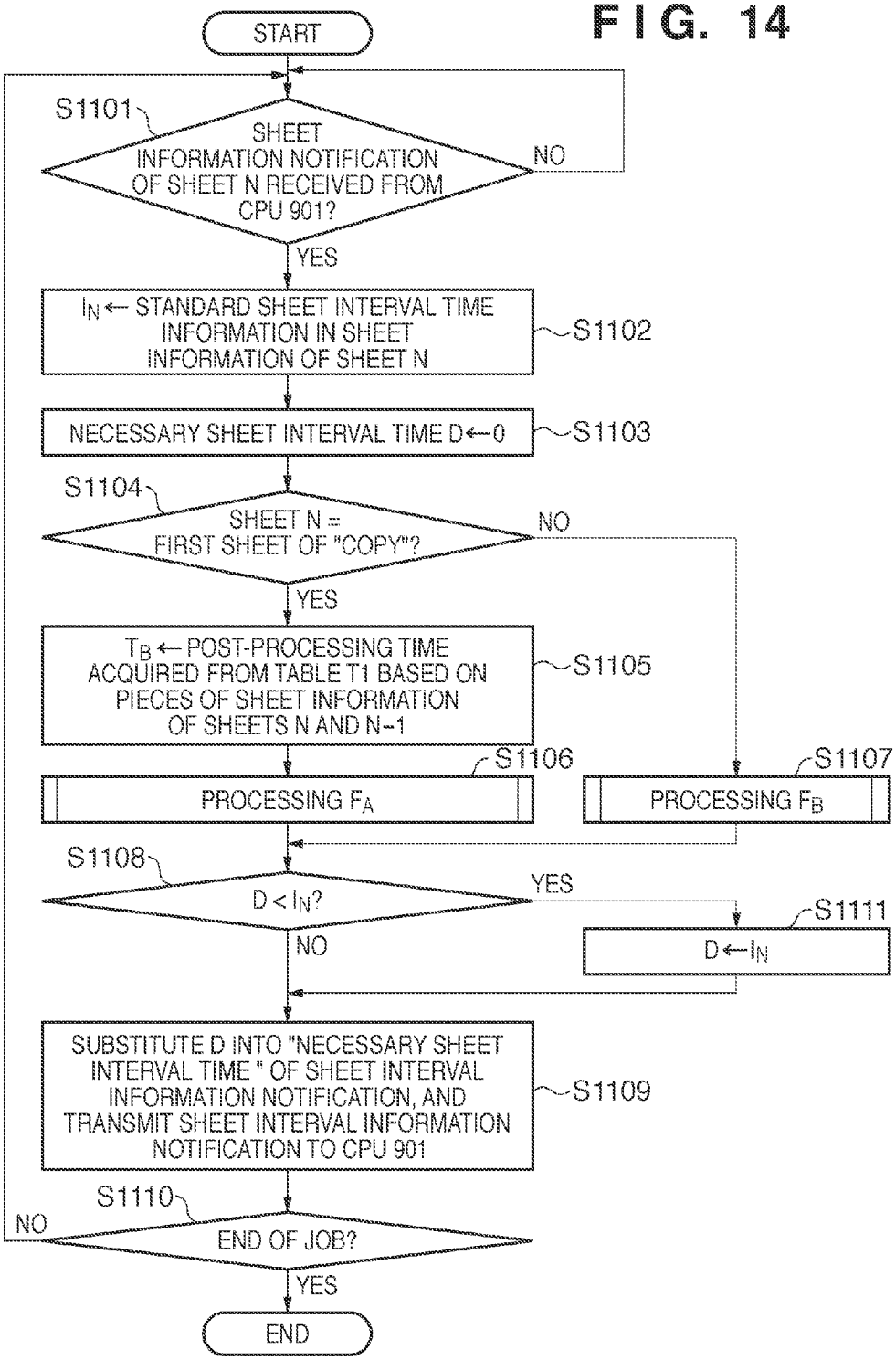
FIG. 14 is a flowchart when the CPU 952 receives a sheet information notification.

In step S1201, the CPU 952 compares the post-processing time $T_B$ acquired in step S1105 shown in FIG. 14 with the standard sheet interval time $I_N$ similarly acquired in step S1102 shown in FIG. 14. If the post-processing time $T_B$ is longer (YES in step S1201), the CPU 952 advances to step S1202; if the post-processing time $T_B$ is equal or shorter (NO in step S1201), to step S1214.

In step S1202, the CPU 952 sets, in a variable buffer sheet counter C in the RAM 954, a value acquired from a buffer sheet count acquisition table T2 shown in FIG. 17 in accordance with the discharge destination and post-processing mode. For example, C=0 for the sorting mode in which sheets are discharged to the sample tray 701, and C=2 for the stitching mode in which sheets are discharged to the stack tray 700. This is information indicating a maximum number of sheets to be overlaid on sheet N. C=0 means that no sheet is overlaid. C=2 means that a maximum of two sheets are wound around the buffer roller and a maximum of three sheets including sheet N are overlaid and conveyed. Assume that the buffer sheet count acquisition table T2 is defined in advance. Information defined in the buffer sheet count acquisition table T2 is not limited to one shown in FIG. 17, and a larger number of values may be defined in correspondence with the apparatus functions and other post-processing modes.

If the CPU 952 determines in step S1203 that the buffer counter C=0 (YES in step S1203), it advances to step S1214; if the buffer counter C exhibits another value (NO in step S1203), to step S1204. In step S1204, the CPU 952 clears, to 0, the variable $T_N$ set in the RAM 954. The bundle interval time $T_N$ serving as a variable stores the lapse of the bundle interval time between a sheet before buffer processing and a sheet bundle having undergone buffer processing in the finisher 500 when sheets are overlaid by buffering.

In step S1205, the CPU 952 transfers sheet information of sheet N to processing $F_C$, and saves the return value in buffer capability information in the RAM 954. In processing $F_C$, whether the sheet can be buffered is checked based on the transferred sheet information, and the buffer capability is returned as a return value (TRUE or FALSE), details of which will be described later.

In step S1206, the CPU 952 determines the buffer capability information of sheet N that has been acquired in step S1205. If the buffer capability information is TRUE, the CPU 952 advances to step S1207; if it is FALSE, to step S1213. In step S1207, the CPU 952 determines whether sheet N is the final sheet of the "copy". If sheet N is the final sheet (YES in step S1207), the CPU 952 advances to step S1213; if it is not the final sheet (NO in step S1207), to step S1208.

In step S1208, the CPU 952 transfers, to processing $F_C$, sheet information of sheet N+1 that is attached to the information of sheet N, and acquires buffer capability information of sheet N+1. The CPU 952 saves the return value of processing $F_C$ in the buffer capability information in the RAM 954. In step S1209, the CPU 952 determines the buffer capability information of sheet N+1 that has been acquired in step S1208. If the buffer capability information is TRUE, the CPU 952 advances to step S1210; if it is FALSE, to step S1213.

In step S1210, the CPU 952 stores "buffer" as the buffer mode of sheet N in the RAM 954, and advances to step S1211. Then, the CPU 952 adds the standard sheet interval time $I_N$ to the bundle interval time $T_N$ (step S1211). In step S1212, the CPU 952 substitutes 0 into the necessary sheet interval time D, and ends processing $F_B$.

If the CPU 952 advances from step S1206, S1207, or S1209 to step S1213, it clears the buffer counter C to 0, and advances to step S1214. In step S1214, the CPU 952 sets "pass" as the buffer mode of sheet N. In step S1215, the CPU 952 substitutes $T_B$ into the necessary sheet interval time D, and ends processing $F_B$.

(Setting of Buffer Mode/Calculation of Necessary Sheet Interval Time: Sheet Other than First Sheet)

Figure 18:
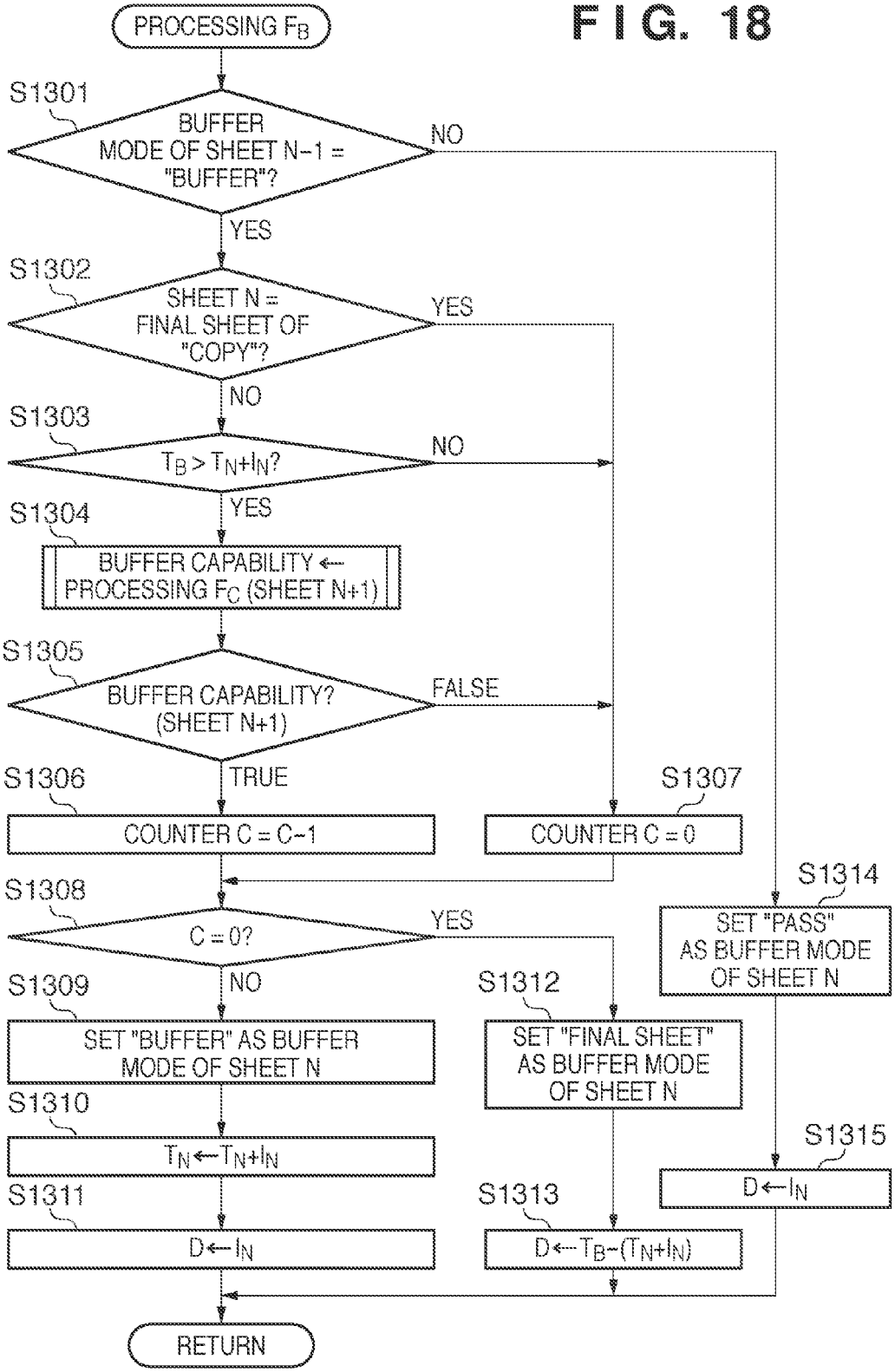
FIG. 18 is a flowchart when the CPU 952 determines a buffer mode.

A sequence when the CPU 952 sets a buffer mode for a sheet of a "copy" other than the first sheet and calculates the necessary sheet interval time in processing $F_B$ will be explained with reference to the flowchart of FIG. 18. Processing by the CPU 952 will be described, unless otherwise specified.

In step S1301, the CPU 952 determines the buffer mode of sheet N−1. If the mode is "buffer" (YES in step S1301), the CPU 952 advances to step S1302; if it is another mode ("final sheet" or "pass"), to step S1314.

In step S1302, the CPU 952 determines whether sheet N is the final sheet of a "copy". If sheet N is not the final sheet (NO in step S1302), the CPU 952 advances to step S1303; if it is the final sheet (YES in step S1302), to step S1307. In step S1303, the CPU 952 compares the processing time $T_B$ with the bundle interval time $T_N$+standard sheet interval time $I_N$ to determine whether the sheet needs to be buffered. If the CPU 952 determines that $T_B > T_N + I_N$ holds (YES in step S1303), buffer processing may increase the productivity, and the CPU 952 advances to step S1304. If the CPU 952 determines that $T_B \leq T_N + I_N$ holds, buffer processing cannot increase the productivity, and the CPU 952 advances to step S1307.

In step S1304, the CPU 952 transfers, to processing $F_C$, sheet information of sheet N+1 that is attached to the information of sheet N, and acquires buffer capability information of sheet N+1. The CPU 952 saves the return value of processing $F_C$ in the buffer capability information in the RAM 954. In step S1305, the CPU 952 determines the buffer capability information of sheet N+1 that has been acquired in step S1304. If the buffer capability information is TRUE, the CPU 952 advances to step S1306; if it is FALSE, to step S1307.

In step S1306, the CPU 952 decrements the buffer counter C by 1, and advances to step S1308. If the CPU 952 advances from step S1302, S1303, or S1305 to step S1307, it clears the buffer counter C to 0, and advances to step S1308. If the CPU 952 determines in step S1308 that the buffer counter C≠0 (NO in step S1308), it advances to step S1309; if it determines that C=0 (YES in step S1308), to step S1312.

In step S1309, the CPU 952 sets "buffer" as the buffer mode of sheet N and saves it in the RAM 954. Then, the CPU 952 adds the standard sheet interval time $I_N$ to the bundle interval time $T_N$ (step S1310). In step S1311, the CPU 952 substitutes the standard sheet interval time $I_N$ into the necessary sheet interval time D, and ends processing $F_B$.

In step S1312, the CPU 952 sets "final sheet" as the buffer mode of sheet N and saves it in the RAM 954. The CPU 952 substitutes, into the necessary sheet interval time D, a time obtained by subtracting the time (bundle interval time $T_N$+standard sheet interval time $I_N$) canceled by the buffer operation from the post-processing time $T_B$ of a preceding sheet bundle (step S1313), and ends processing $F_B$. In step S1314, the CPU 952 sets "pass" as the buffer mode of sheet N and saves it in the RAM 954. In step S1315, the CPU 952 substitutes the standard sheet interval time $I_N$ into the necessary sheet interval time D, and ends processing $F_B$.

(Determination of Buffer Capability)

A sequence when the CPU 952 determines the buffer capability based on transferred sheet information in processing $F_C$ will be explained with reference to the flowchart of FIG. 19. Processing by the CPU 952 will be described, unless otherwise specified.

In steps S1401 to S1403, the CPU 952 determines whether sheet material type information in sheet information transferred to processing $F_C$ corresponds to one of an OHP sheet, coated paper, and index paper. If the sheet corresponds to one of these types, the CPU 952 advances to step S1408; if it corresponds to none of them, to step S1404.

The CPU 952 determines in step S1404 whether the grammage falls within the range of 50 gsm to 200 gsm, determines in step S1405 whether the paper width falls within the range of 182 mm to 297 mm, and determines in step S1406 whether the paper length falls within the range of 182 mm to 216 mm. If NO in step S1404, S1405, or S1406, the CPU 952 advances to step S1408; if YES in step S1404, S1405, and S1406, to step S1407.

In step S1407, the CPU 952 determines that the sheet can be buffered, and substitutes TRUE into the result. In step S1408, the CPU 952 determines that the sheet cannot be buffered, and substitutes FALSE into the result. The CPU 952 returns the result as a return value, and ends processing $F_C$.

Figure 19:
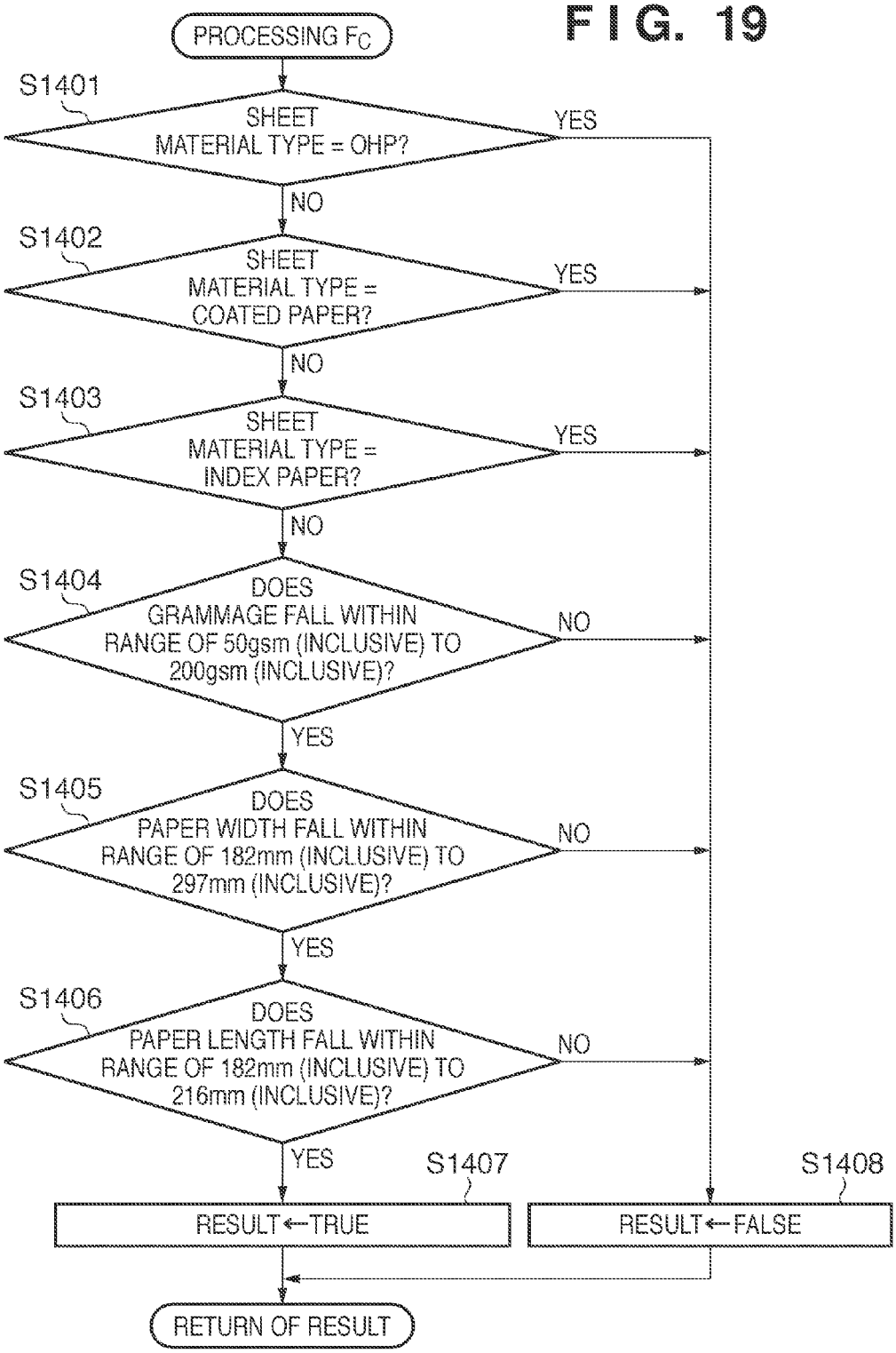
FIG. 19 is a flowchart when the CPU 952 determines buffer capability.

Note that each sheet material type and the specifications (for example, size and grammage) of each sheet in the determination of FIG. 19 can be changed in accordance with the functions and specifications of an apparatus to which the present invention is applied. Hence, the sheet material types and specifications are not limited to the values and conditions shown in FIG. 19.

As described above, according to the present invention, when determining whether to perform buffer processing for sheet N, the determination is made based on not only the buffer capability determination result of sheet N but also that of sheet N+1. Even when sheet N+1 cannot be buffered, post-processing can be executed at an optimum sheet interval regardless of a combination of sheets without generating cancelation of buffer processing after buffering sheet N.

Figure 20:
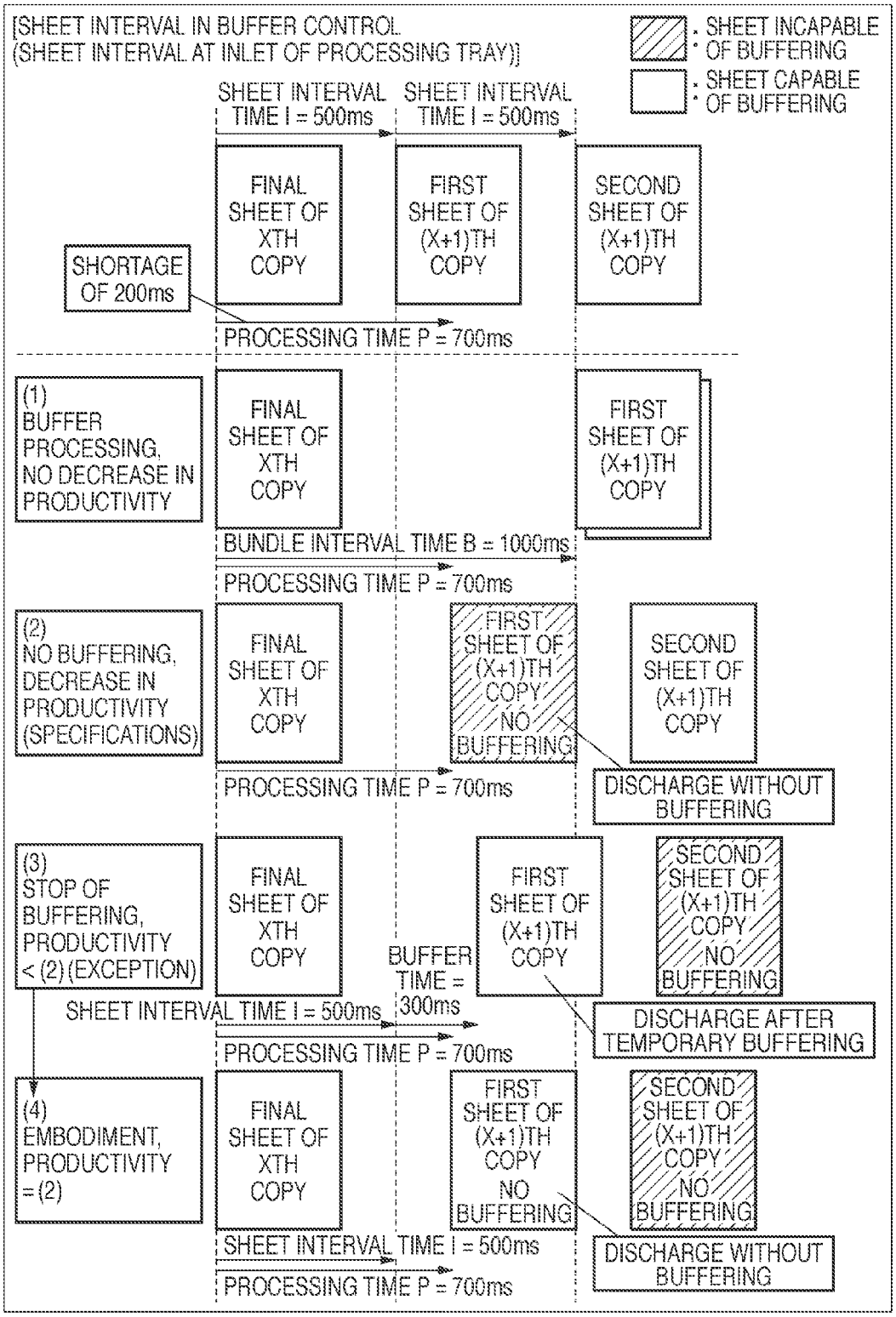
FIG. 20 is a view for explaining the sheet interval in buffer control.

A concrete difference between the prior art and the embodiment will be described with reference to FIG. 20. As shown at the top stage of FIG. 20, assume that the sheet interval time I=500 ms, and the processing time P=700 ms is necessary for the final sheet of a sheet bundle. In this case, the sheet interval time becomes short by 200 ms to process the final sheet. At this time, if the first sheet of the next sheet bundle ((X+1)th copy) can be buffered, the time (bundle interval time B) between sheet bundles can be set longer than the processing time P, so the productivity is not affected. In FIG. 20, the bundle interval time B=1,000 ms. At this time, the sheet interval time I=500 ms remains unchanged.

A case in which the first sheet of the next sheet bundle ((X+1)th copy) cannot be buffered in conventional buffer control will be examined. Since the first sheet cannot be buffered, the first sheet of the next sheet bundle is conveyed upon the lapse of the processing time P. If the sheet interval time I=500 ms remains unchanged, discharge delays by the time (200 ms) taken until processing of a preceding sheet bundle ends.

However, in the conventional buffer control, the following situation may occur. Assume that the first sheet of the next sheet bundle ((X+1)th copy) can be buffered and the second sheet cannot be buffered. In this case, the first sheet is buffered till the lapse of the processing time P for the final sheet of a preceding sheet bundle (Xth copy). However, the second sheet cannot be buffered, so buffering of the first sheet which has been temporarily buffered is canceled, and the first sheet is discharged. In this case, discharge of the first sheet is delayed by the buffer time (300 ms). If the sheet interval time I between the first and second sheets of the next sheet bundle ((X+1)th copy) remains 500 ms, they discharge is delayed much more than in the aforementioned case in which the first sheet is conveyed upon the lapse of the processing time P. The productivity of the system therefore decreases much more than in a case where the first sheet waits till the end of processing a preceding sheet bundle without buffering the first sheet, and then is discharged. This is because only information of the first sheet of a sheet bundle is used to determine whether or not to buffer the first sheet, and when the second sheet cannot be buffered, the first and second sheets are discharged without overlaying them (cancelation of buffering).

In contrast, according to the embodiment, whether or not to buffer the Yth sheet is determined using pieces of sheet information of the Yth and (Y+1)th sheets of the next sheet bundle ((X+1)th copy). This can prevent a decrease in productivity which may occur in the prior art.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-114709, filed May 18, 2010, and No. 2011-083126, filed Apr. 4, 2011, which are hereby incorporated by reference herein in their entirety.

What is claimed is:

1. An image forming apparatus comprising:

an image forming unit configured to formed an image on a sheet;

a sheet conveyance unit configured to convey a sheet formed by the image forming unit;

a sheet stacking unit configured to stack a plurality of sheets conveyed by the sheet conveyance unit;

a post-processing unit configured to perform post-processing for a sheet bundle including the plurality of sheets stacked by the sheet stacking unit;

a buffer unit arranged upstream of the sheet stacking unit and configured to perform a buffer processing that retains one or more sheets and to overlay the one or more sheets retained and a succeeding sheet;

an acquisition unit configured to acquire sheet information for determining whether a sheet is inhibited from the buffer processing by the buffer unit; and a control unit configured to control, based on the sheet information of an (N+1)th sheet, the buffer unit regarding whether the buffer unit should retain an Nth sheet, in a case where an Nth sheet is not inhibited from the buffer processing by the buffer unit.

2. The apparatus according to claim 1, wherein in a case where the Nth sheet is a sheet not inhibited from the buffer processing:

when the (N+1)th sheet is a sheet inhibited from the buffer processing, the control unit controls the buffer unit not to retain the Nth sheet; and when the (N+1)th sheet is not a sheet inhibited from the buffer processing, the control unit controls the buffer unit to retain the Nth sheet.

3. The apparatus according to claim 1, wherein in a case where the (N+1)th sheet is a sheet inhibited from the buffer processing:

when the Nth sheet is the first sheet of the next sheet bundle, the control unit controls the buffer unit not to retain the Nth sheet; and when the Nth sheet is a sheet other than the first sheet of the next sheet bundle, the control unit controls the buffer unit to overlay the one or more sheets retained by the buffer unit prior to the Nth sheet, and the Nth sheet, and convey the one or more sheets and the Nth sheet to the sheet stacking unit.

4. The apparatus according to claim 1, wherein when not retaining the Nth sheet, the control unit controls to set a discharge interval between the Nth sheet and a preceding (N−1)th sheet from the image forming unit to be larger than the discharge interval when retaining the Nth sheet.

5. The apparatus according to claim 1, wherein the sheet information includes at least one of sheet size, basis weight of a sheet, sheet material type, or post-processing type to be performed.

6. The apparatus according to claim 1, wherein a sheet inhibited from the buffer processing is one of:

a sheet whose sheet size falls outside a predetermined size range, a sheet whose basis weight in the sheet information falls outside a predetermined basis weight range, or a sheet whose sheet material type in the sheet information is one of index sheet, an OHP sheet, or a coated sheet.

7. The apparatus according to claim 1, wherein when sheets retained by the buffer unit include a sheet having a different sheet size, the control unit controls the buffer unit not to retain a sheet.

8. The apparatus according to claim 1, wherein the control unit controls the buffer unit to retain, during post-processing for a sheet bundle stacked by the sheet stacking unit, a sheet succeeding the sheet bundle stacked by the sheet stacking unit.

9. An image forming apparatus comprising:

an image forming unit configured to formed an image on a sheet;

a sheet conveyance unit configured to convey a sheet on which an image has been formed by the image forming unit;

a sheet stacking unit configured to stack a plurality of sheets conveyed by the sheet conveyance unit;

a post-processing unit configured to perform post-processing for a sheet bundle including the plurality of sheets stacked by the sheet stacking unit;

a buffer unit arranged upstream of the sheet stacking unit and configured to perform a buffer processing that retains one or more sheets and to overlay the one or more sheets retained and a succeeding sheet;

an acquisition unit configured to acquire sheet information for determining whether a sheet is inhibited from the buffer processing by the buffer unit; and a control unit configured to control, in a case where the first sheet of a predetermined number of sheets succeeding a sheet bundle to which the post-processing is executed by the post-processing unit is not inhibited from the buffer processing, the buffer unit regarding whether the buffer unit should retain the sheet, based on the sheet information of sheets other than the first sheet of the predetermined number of sheets.

10. The apparatus according to claim 9, wherein in a case where the first sheet of the predetermined number of sheets succeeding the sheet bundle to which the post-processing is executed by the post-processing is not inhibited from the buffer processing, the control unit inhibits from executing a buffer processing to the first sheet if sheets other than the first sheet of the sheet bundle is inhibited from the buffer processing.

11. The apparatus according to claim 9, wherein the sheet information includes at least one of sheet size, basis weight of a sheet, sheet material type, or post-processing type to be performed.

* * * * *